US011969088B2

(12) United States Patent
Woolson et al.

(10) Patent No.: US 11,969,088 B2
(45) Date of Patent: Apr. 30, 2024

(54) GUIDE RAIL, GUIDE SYSTEM AND FURNITURE ITEM

(71) Applicant: GRASS AMERICA, INC., Kernersville, NC (US)

(72) Inventors: Story Woolson, Madison, NC (US); Toni Hayes, Stuart, VA (US); Manfred Peer, Walkertown, NC (US); Georg Domenig, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 37 days.

(21) Appl. No.: 17/645,483

(22) Filed: Dec. 22, 2021

(65) Prior Publication Data

US 2023/0189992 A1 Jun. 22, 2023

(51) Int. Cl.
*A47B 88/483* (2017.01)
*A47B 88/43* (2017.01)

(52) U.S. Cl.
CPC ..... *A47B 88/483* (2017.01); *A47B 88/43* (2017.01)

(58) Field of Classification Search
CPC ..... A47B 88/483; A47B 88/43
See application file for complete search history.

(56) References Cited

U.S. PATENT DOCUMENTS 1,545,016 A * 7/1925 Sessions ..... A47B 88/483 248/248
4,351,575 A * 9/1982 Rock ..... A47B 88/493 312/334.12
5,292,198 A * 3/1994 Rock ..... A47B 88/43 312/333
5,641,216 A * 6/1997 Grass ..... A47B 88/483 312/334.32
6,142,596 A * 11/2000 Carson ..... A47B 88/487 312/330.1
6,325,473 B1 * 12/2001 Brustle ..... A47B 88/487 312/334.6
6,481,812 B1 * 11/2002 Domenig ..... A47B 88/467 312/334.6
6,659,576 B1 * 12/2003 Welch ..... A47B 88/43 312/334.41
9,756,941 B1 * 9/2017 Rowland ..... A47B 88/427
11,583,077 B2 * 2/2023 Salice ..... A47B 88/43
2003/0205955 A1 * 11/2003 Egger ..... A47B 88/43 312/334.5

(Continued)

*Primary Examiner* — Hanh V Tran
(74) *Attorney, Agent, or Firm* — BURR PATENT LAW, PLLC

(57) ABSTRACT

A guide rail including a rail body and a fastening element having a narrow front edge portion abutting the rail body, and configured as a bracket element from an angled sheet metal material with limbs oriented at an angle and connected along a bending edge, and a horizontal limb forming the flat material portion with the upper side and with the underside of the flat material portion with the edge portion. A horizontal limb of the bracket element has an inner limb portion adjoining the bending edge and an outer limb portion adjoining the inner limb portion via a longitudinally extending shoulder. The outer limb portion includes the edge portion and a reinforcing mechanism is provided on the fastening element as an arch extending along the shoulder over a partial region of the outer limb portion and over the shoulder and over part of the inner limb portion.

14 Claims, 11 Drawing Sheets

(56) References Cited

U.S. PATENT DOCUMENTS

| | | | | |
|---|---|---|---|---|
| 2005/0225219 | A1* | 10/2005 | Chen | A47B 88/43 312/334.5 |
| 2008/0157643 | A1* | 7/2008 | Chen | A47B 88/47 312/334.6 |
| 2009/0072690 | A1* | 3/2009 | Bubolz | A47B 88/43 312/334.1 |
| 2011/0012492 | A1* | 1/2011 | Radusin | A47B 88/43 312/334.8 |
| 2012/0288221 | A1* | 11/2012 | Jahrling | A47B 88/47 384/20 |
| 2013/0156353 | A1* | 6/2013 | Rehage | A47B 88/423 384/22 |
| 2013/0278125 | A1* | 10/2013 | Lang | A47B 88/443 312/334.1 |
| 2014/0265785 | A1* | 9/2014 | Chen | A47B 88/40 312/334.1 |
| 2014/0334751 | A1* | 11/2014 | Meyer | F24C 15/168 384/22 |
| 2016/0278521 | A1* | 9/2016 | Chen | A47B 88/42 |
| 2017/0065081 | A1* | 3/2017 | Janzen | A47B 88/407 |
| 2017/0172300 | A1* | 6/2017 | Bowman | A47B 88/487 |
| 2017/0184151 | A1* | 6/2017 | Huang | F16C 29/02 |
| 2017/0292777 | A1* | 10/2017 | Lee | A47B 88/483 |
| 2018/0055224 | A1* | 3/2018 | Mason | A47B 88/487 |
| 2018/0271274 | A1* | 9/2018 | Gasser | A47B 88/941 |
| 2019/0166994 | A1* | 6/2019 | Rihtarec | A47B 88/427 |
| 2019/0166999 | A1* | 6/2019 | Albrecht | A47B 88/45 |
| 2020/0256044 | A1* | 8/2020 | Kim | G07C 9/37 |

* cited by examiner

GUIDE RAIL, GUIDE SYSTEM AND FURNITURE ITEM

FIELD OF THE INVENTION

The present invention relates to a guide rail, guide system and a furniture item.

BACKGROUND OF THE INVENTION

Guide systems for displaceable movable push-in elements, such as, for example, linear guides, have, for example, two or more guide rails which are displaceable telescopically with respect to one another and act, on the one hand, on the push-in element and, on the other hand, on a mating portion. For example, push-in elements of a furniture item, such as drawers, are received on a cabinet of a furniture item in a manner movable linearly via guide systems, such as what are referred to as partial-extension or full-extension mechanisms. For a push-in element, generally two identical guide systems are used. Pull-out guides for drawers of furniture items are generally produced from sheet metal material and subjected to a sheet metal machining process, for example, by means of punching and bending.

In the case of a, for example, drawer guide system, generally precisely two partial-extension or full-extension mechanisms are provided for the linear movement of a drawer relative to the furniture cabinet, the mechanisms therefore being present in pairs on a drawer. In the production of a guide structural unit, a stable and material-saving configuration is obtained.

The respective guide system carries the push-in element and is fastened preferably to an inner face of a furniture cabinet. The furniture item can be a box-shaped furniture item with sidewalls and a rear wall, or one sidewall or both sidewalls are omitted, for example, in what are referred to as face-frame furniture items. The guide system is adapted for the different furniture items. When sidewalls are omitted, the guide systems are then mounted, for example, on front and/or rear furniture cabinet portions.

SUMMARY OF THE INVENTION

It is the object of the present invention to improve an aforementioned guide rail, a guide system formed therewith, and a relevant furniture item. In particular, a guide structural unit is intended to be of a compact design and to be able to support comparatively high mechanical loads.

The present invention is based on a guide rail of a guide system for a push-in element, the guide rail comprising a rail body and a fastening element, the fastening element being configured in such a way as to fasten the guide rail on a mating portion, such as a furniture wall, in the state of use of the guide system, the fastening element being mounted on the rail body and being connected thereto, and the fastening element having a flat material portion with opposite main sides and with a narrow front edge portion between the main sides, in the state with the fastening element connected to the rail body, the edge portion of the fastening element abutting a surface side on the rail body, which surface side is oriented upright in the state of use of the rail guide, the fastening element being configured in the basic form as a bracket element from an angled sheet metal material with limbs oriented at an angle and being connected to each other along a bending edge, and, in the state of use, a horizontally configured horizontal limb forming the flat material portion with the edge portion. The horizontal limb is formed by the flat material portion with an upper side, which forms an upper main side, and with an underside, which forms a lower main side. The edge portion bridges the distance between the upper main side and the lower main side and comprises in particular a narrow strip-shaped front face of the horizontal limb or of the flat material portion. The edge portion is connected by the flat surface of the front face to the surface side on the rail body by cohesive bonding, for example, is laser welded. The connected surfaces of the front face and of the surface side are accordingly preferably oriented parallel for optimized mutual full-area surface contact.

The guide rail is, for example, a fixed rail of a guide system, such as, for example, of a partial-extension mechanism or of a full-extension mechanism. The fixed rail, and therefore the associated guide system, is fastenable, for example screwable, in a fixed position to the mating portion, such as the furniture wall, via the fastening element. As a rule, the guide rail comprises precisely two fastening elements. The fastening elements of a guide rail are, for example, identical. Alternatively, a first fastening element of a guide rail differs from another fastening element. The fastening elements serve for the attachment to the mating portion, such as, for example, to a portion of a furniture cabinet. The guide rail is preferably in the form of a sheet-metal bent part made from sheet metal or steel material by, for example, punching and bending. The rail body comprises, for example, a base which is oriented horizontally in the state of use and extends, for example, in a strip-shaped manner in the longitudinal direction of the guide rail. For example, on both sides of the base, in the longitudinal direction of the rail body there is in each case a vertical side of the rail body which is at an angle to the base. The respective side has an outer face, wherein the edge portion, for example, the front face of the flat material portion of the horizontal limb is in abutting contact with, or abuts, precisely one outer face. The outer face of the side of the rail body forms the surface side which is oriented upright. The guide rail together with the base and respectively lateral sides which are angled, for example, at a right angle to the base is, for example, U-shaped. In the state of use, the guide rail is, for example, open upward. A partial height of the sides extending downward from a respective upper longitudinal edge of the rail body is, for example, oriented obliquely by the opposite edges being bent, for example, toward each other. On the surface side, i.e. outer side on a side of the guide rail facing the cabinet, the surface side is formed for the connection to the fastening element. The fastening element which, prior to the connection on the rail body, is a separate sheet metal part is mounted on the rail body by an abutting connection, for example, is adhesively bonded, soldered or welded thereto, for example, is connected thereto by laser welding.

The bracket element is, for example, a single piece and is formed, for example, from an originally flat metal sheet. The bracket element has, for example, a vertical limb which is oriented vertically in the state of use and is connected integrally to the horizontal limb via the bending edge which runs, for example, parallel to the longitudinal direction of the rail body. The bending edge connects the two limbs which are oriented, for example, at a right angle to each other, or the horizontal limb and the vertical limb. A rear face of the vertical limb is configured for, for example, flat contact with the mating portion. The vertical limb has, for example, openings which serve for screwing means to reach through for screwing to the mating portion. The guide rail, and, therefore, the push-in element accommodated on the guide, is thus fastenable to the mating portion, such as a cabinet wall.

The flat material portion is formed, for example, by the sheet metal material from which the fastening element is formed by, for example, a bending and forming operation. Therefore, one side, such as an upper side of the sheet metal material, forms the one main side of the flat material portion and the other side, such as an underside of the sheet metal material, forms the other main side of the flat material portion. In between, in accordance with the thickness of the sheet metal material, the edge portion with the narrow front face of the edge portion being perpendicular to the main sides is formed. The edge portion is produced in a manner encircling the fastening element. A rectilinear portion of the edge portion, running parallel to the bending edge, the rectilinear portion delimiting the outer limb portion on the latter, abuts the surface side on the rail body.

The essence of the present invention consists in that the horizontal limb has an inner limb portion adjoining the bending edge and an outer limb portion, wherein the outer limb portion adjoins the inner limb portion via a shoulder which extends in the longitudinal direction of the rail body, and wherein the outer limb portion has the edge portion, wherein there are reinforcing means on the fastening element, comprising an arch which extends along the shoulder over a partial region of the outer limb portion. The arch ends, for example, at the shoulder. The arch reaches, for example, from the outer limb portion into the shoulder.

The arch preferably extends in the region of the shoulder. The arch preferably extends over a partial length of the shoulder, as viewed in the longitudinal direction of the guide rail. The arch preferably extends over the entire width of the shoulder over a partial length of the shoulder. The arch preferably extends beyond the region of the shoulder. For example, the arch reaches from the shoulder into a region which adjoins the shoulder.

The arch extends, for example, over a partial region of the inner limb portion.

The arch preferably extends over a partial region of the outer limb portion along the shoulder and reaches into the inner limb portion. The arch preferably extends over a partial region of the outer limb portion and over the shoulder and over a partial region of the inner limb portion.

The inner limb portion which preferably is horizontal in the state of use extends from the bending edge as far as the shoulder. The shoulder is preferably linear. The shoulder is oriented, for example, parallel to the bending edge. The shoulder is formed, for example, by a narrow strip-shaped region of the horizontal limb. The shoulder comprises, for example, two parallel bending lines and, between the bending lines, a narrow strip-shaped region which has a width in the millimeter range, for example, of 1 or 2 millimeters. The shoulder when oriented in accordance with the state of use forms a step upward from the inner limb portion. The outer limb portion is therefore located higher than the inner limb portion. In the state of use, the outer limb portion is preferably oriented horizontally.

The outer limb portion extends from the shoulder as far as the front edge portion, the front face of which abuts the rail body. The relevant front face is oriented facing the rail body.

The horizontal limb spans a horizontal distance between the vertical limb and the rail body or the surface side oriented upright on the rail body.

The effect achieved by the reinforcing mechanisms, along with simple production of the fastening element, is high mechanical stability of the guide rail or of the fastening element and of the connection to the rail body. In addition, the fastening element can be provided in a manner saving on material. In particular, proceeding from the starting material of the fastening element, such as a flat sheet metal part, no additional material is necessary for increasing the stability or for the reinforcement. On the contrary, the sheet metal material which is present in any case is sufficient, simply by means of a corresponding shaping in accordance with the arch. The arch on the fastening element is, for example, stamped on the fastening element. The arch is, for example, deformed with respect to a remaining, adjoining, flat, undeformed sheet metal portion, proceeding from the starting material of the flat sheet metal material. The arch can be formed on the fastening element, which is formed from sheet metal material, for example, by a stamping operation. This can advantageously take place in an operation during the production or a bending deformation of the originally flat, plane sheet metal material. No additional component and/or additional connecting method is necessary for providing the reinforcement of the fastening element.

In the region of the outer limb portion, i.e. as far as the shoulder, the arch is, for example, elongate and strip-shaped. The arch does not end, for example, at the shoulder, but rather merges into the shoulder and beyond the latter further on the horizontal limb. With respect to the outer limb portion, the arch has an arch edge which is directed toward the rail body or is directed toward the edge portion. The portion of the arch edge is, for example, spaced apart somewhat from the edge portion with the abutting connection. Accordingly, the arch edge or the arch does not reach, for example, as far as the edge to the front face of the edge portion. The relevant arch edge runs, for example, over the entire or preferably over a partial length of the edge portion with the abutting connection.

The arch is configured, for example, in the form of a trough in the sheet metal material of the fastening element. The arch preferably has a plane upper side and correspondingly, on the other side of the sheet metal material, a plane underside. The arch has a uniform height, for example, over its entire extent and forms a plane upper side and, correspondingly, a plane underside with a, for example, bent edge of the arch. The height of the arch to the non-stamped plane portions of the fastening element lies, for example, in the millimeter range, with respect to a distance of an upper side of the arch from an upper side of the sheet metal material, not deformed in an arched manner, of the fastening element. The height of the arch corresponds, for example, to half the sheet metal thickness of the sheet metal material of the fastening element and is, for example, circa 1 to 2 millimeters. The arch is configured to be raised, or is formed as an elevation, with respect to the state of use and with respect to adjacent portions, which adjoin the arch, of the fastening element on an upper side of the fastening element. The arch is configured to be recessed, or is formed as a depression, with respect to the state of use and with respect to adjacent portions, adjoining the arch, of the fastening element on an underside of the fastening element.

In an advantageous manner, the reinforcing mechanisms on the outer limb portion extend over the length of the front edge portion, as viewed in the longitudinal direction of the guide rail. Expressed in other words, an edge of the arch spans a part or the entire longitudinal extent of the edge portion. For example, an edge of the arch directed toward the edge portion extends over a substantial length or the entire length of the edge portion that abuts the surface side on the rail body. The effect achieved by the reinforcement along the abutting connection is that the guide rail is stabilized. The length of the edge portion runs, for example, in the longitudinal direction of the guide rail. The arch preferably remains spaced apart somewhat from the edge portion and, therefore, from the surface side on the rail body.

The reinforcing mechanisms which comprise the arch or, for example, are formed exclusively by the arch extend with the arch on the outer limb portion over a length of 70%, 80% or 90% of the length of the front edge portion that abuts the surface side. An associated edge of the arch that forms a transition upward or downward to the non-arched material preferably runs parallel to the edge portion or parallel to an edge between the edge portion and a main side of the horizontal limb. Mechanical stabilization in the particularly mechanically critical or stressed region or vicinity of the abutting connection is, therefore, advantageously achieved.

The reinforcing mechanisms extend with respect to the entire surface of the outer limb portion over at least 50% of the entire surface of the outer limb portion, for example, over 60%, 70%, 80% or more of the entire surface of the outer limb portion. For example, only a narrow front edge-side strip, a rear edge-side strip and an edge strip of the outer limb portion that is positioned with respect to the rail body remains free of the arch or flat without an arch.

An edge of the arch advantageously remain spaced apart somewhat, for example, in the millimeter range, from an edge on the front edge portion, wherein the edge runs between the edge portion and an upper side or underside of the outer limb portion.

Furthermore, it is proposed that the reinforcing mechanisms are formed in a central portion of the horizontal limb with respect to the longitudinal direction of the guide rail. The longitudinal direction of the guide rail coincides with the longitudinal direction of the fastening element. With respect to the longitudinal direction of the fastening element, the arch remains spaced apart, for example, from a front edge and/or from a rear edge of the fastening element or of the horizontal limb. The region without an arch, from the edge thereof as far as the front or rear longitudinal edge of the fastening element or of the horizontal limb, is, for example, undeformed or unstamped in relation to the original sheet metal material. The region without an arch is, for example, not raised or recessed with respect to the flat unmachined sheet metal material. In the width direction transversely with respect to the longitudinal direction, the arch advantageously remains spaced apart somewhat from the front edge portion. Otherwise, the arch is present, for example, continuously, for example, over the remaining outer limb portion, the shoulder and the inner limb portion as far as the bending edge and, for example, further into the vertical limb.

The reinforcing mechanisms, i.e., for example, the arch, are preferably formed on the horizontal limb symmetrically with respect to a vertical mirror plane which is central in the longitudinal direction and arises perpendicularly to the longitudinal direction of the guide rail. The reinforcing mechanisms preferably extend on the horizontal limb over a greater length on the outer limb portion and on the shoulder, as viewed in the longitudinal direction of the guide rail, than on the inner limb portion. For example, the reinforcing mechanisms, i.e. the arch, on the outer limb portion and on the shoulder are twice or three times as long as on the inner limb portion.

For example, the arch is configured continuously as an uninterrupted arch which is present at the outer limb portion and in the region of the shoulder. The arch, such as, for example, an elevation, or, on the other main side, a depression, which has a closed border, is, therefore, configured in such a manner that within the arch there is no portion which is not pressed in or deep drawn or there is no un-arched material. The arch is preferably configured as a continuous, cohesive arch. For example, the arch is configured continuously without interruption from the outer limb portion over the shoulder as far as the inner limb portion.

One advantage consists in that the arch is formed in the region of the bending edge between the horizontal limb and the vertical limb. For example, the arch extends over the bending edge into the region of the vertical limb. The arch advantageously extends continuously from the horizontal limb over the bending edge into the region of the vertical limb. The arch spans the bending edge transversely with respect to its longitudinal extent. The arch is preferably present only over a central longitudinal portion of the bending edge.

Furthermore, it is advantageous that the arch extends over the horizontal limb over the bending edge and the vertical limb. For example, the arch extends over the outer limb portion, over the shoulder, over the inner limb portion, over the bending edge and over the vertical limb. The arch can be interrupted at one or more points. The arch is preferably configured continuously or without an interruption and is, for example, deep drawn. The arch is configured, for example, continuously without an interruption over the outer limb portion, over the shoulder, over the inner limb portion, over the bending edge and over the vertical limb.

It is advantageous if the shoulder between the inner limb portion and the outer limb portion runs continuously over the entire length of the horizontal limb. A mechanically reinforced fastening element is therefore provided. The shoulder is, for example, in the shape of a web, staircase or step. The shoulder is also present in the region in which the arch is formed. Or conversely, the arch is also configured in the region of the shoulder, over at least a partial length of the shoulder. Only the shape of the shoulder is superimposed on the region of the arch by the shape of the arch. The step-like shape is additionally configured to be arched here. This increases the rigidity of the fastening element.

With respect to the state of use, the shoulder comprises, for example, a narrow portion which is angled obliquely upward from the inner limb portion, for example, over the entire length thereof. The portion protrudes upward on the inner limb portion, for example, between 30 and 50 angular degrees, for example, at 45 angular degrees to the horizontal, with respect to the state of use. The shoulder reaches from a lower bending line as far as an upper bending line parallel to the lower bending line. The bending lines are parallel to the bending edge. The lower bending line is adjacent to the inner limb portion. The upper bending line is adjacent to the outer limb portion. The shoulder can alternatively be configured in the form of a channel or, for example, as a bead or fold or, for example, can be configured as a thickening of the material, for example, as a bulge. The shoulder preferably runs in a stepped manner parallel to the bending edge.

It is of advantage if the outer limb portion is offset in the vertical direction with respect to the inner limb portion with respect to the state of use. A compact and stable configuration of the guide rail is therefore made possible. In particular, an underside of the inner limb portion can remain in the region or over an underside of the rail body, and the edge portion on the outer limb portion engages for this purpose somewhat further upward on the rail body.

The outer limb portion is preferably offset upward with respect to the inner limb portion. With respect to the state of use and as viewed from above, the outer limb portion is rectilinear on one longitudinal side, along the shoulder, and, on the other longitudinal side, is stepped in outline, i.e. with its longitudinal side which is directed toward the rail body and which has, for example, a protruding, central, rectilinear partial length. The central rectilinear partial length has the edge portion on the front face. Accordingly, the front face of the central partial length abuts the surface side of the rail body. Alternatively, the entire side of the outer limb portion directed toward the rail body can form a rectilinear line, as viewed from above or in top view. The edge portion is thus formed over the entire length of the relevant side of the outer limb portion, and, therefore, an optimized surface connection to the surface side on the rail body is possible.

A modification is produced if the edge portion over its entire length with respect to the longitudinal direction of the guide rail abuts the upright surface side on the rail body. As a result, the entire surface of the edge portion is used for abutting the surface side. For example, the edge portion with the narrow front face which abuts the surface side of the rail body is formed over the entire or at least the substantial length of the horizontal limb or over the length of the outer limb portion. Therefore, the connection between edge portion and surface side on the rail body is configured over the maximum available length of the fastening element.

For example, the edge portion with respect to its length arising in the longitudinal direction of the guide rail or of the rail body over at least 80% of its length abuts the upright surface side on the rail body. For an advantageous production of the guide rail, it is possible, for example, for a comparatively short partial length of the edge portion not to abut the rail body.

For example, the edge portion comprises a central partial length which abuts the surface side of the rail body, wherein, adjoining the central partial length at the front and rear, a further partial length to the central partial length of the edge portion is spaced apart from the surface side of the rail body.

The front and/or rear partial length, as viewed in the longitudinal direction of the rail body, is comparatively short with respect to the central partial length of the edge portion.

In an advantageous manner, the fastening element is connected to the surface side on the rail body exclusively via the abutting connection. This is advantageous in terms of production.

For example, on the rail body of the guide rail there is precisely one fastening element, the edge portion of which abuts the surface side of the rail body. There is preferably at least one further fastening element which is present, or is mounted connected, on the guide rail in some other way than the precisely one fastening element. A further fastening element can engage in a non-abutting manner on the guide rail. Even furniture items without a sidewall can, therefore, be advantageously operated.

According to a further refinement, on the rail body of the guide rail there are precisely two identically configured fastening elements with an edge portion, the respective edge portion of which abuts the surface side of the rail body. Therefore, all of the fastening elements are identical, or only precisely one type of fastening elements is necessary.

Alternatively, more than two fastening elements are provided, wherein precisely one fastening element abuts the surface side of the rail body. Also precisely two fastening elements or all the fastening elements can abut the surface side of the rail body.

For example, on the rail body of the guide rail there is precisely one fastening element which abuts the surface side of the rail body, wherein there is a further fastening element which differs from the first fastening element in the configuration and/or in the manner of the connection to the rail body. Different applications can, therefore, be operated flexibly.

A further fastening element is connected releasably to the rail body, for example, preferably by a plug-in connection. Alternatively, the further fastening element can be connected releasably to an attachment piece which is present on the rail body. For example, the precisely one fastening element is a front fastening element which abuts the surface side of the rail body, and the further fastening element is a fastening element which is present in the longitudinal direction of the rail body in a manner offset toward a rear end on the rail body.

The rear fastening element is configured, for example, to be mounted releasably, for example attachably, to the rail body or to an attachment piece.

It is also conceivable for more than three fastening elements to be provided on the guide rail. Precisely one or precisely two or all of the fastening elements by the respective edge portion abut the surface side on the rail body.

In an advantageous manner, an attachment piece with an edge portion is provided, wherein the edge portion of the attachment piece abuts the surface side on the rail body, wherein a fastening element is attachable to the attachment piece. The attachment piece is provided for the attachment of a rear fastening element of the guide rail. The fastening element and the attachment piece can be plugged together, for example, in a clamping manner. The attachment takes place, for example, by pushing the rest of the guide rail from the front onto the rear fastening element which is already mounted, for example, on the furniture cabinet. The front fastening element is mounted, for example, fixedly abutting the rail body, as described above.

The present invention also extends to a guide system for a push-in element, with a cabinet rail which is configured as a guide rail according to one of the refinements described above. The guide system relates, for example, to a guide system for a push-in element, in particular, linear guide system for a push-in element of a furniture item, wherein the guide system comprises a structural unit with precisely two guide rails, wherein the structural unit has a cabinet rail and a push-in element rail which is accommodated displaceably on the cabinet rail and is configured for connection to the push-in element, wherein there is a bearing arrangement between portions of the cabinet rail and portions of the push-in element rail for a relative movement of cabinet rail and push-in element rail, wherein the cabinet rail is configured as a guide rail according to one of the above-described developments.

An advantageous partial-extension mechanism is therefore provided, i.e. a rail guide without a central rail between the cabinet rail and the push-in element rail.

In addition, a guide system is proposed for a push-in element, in particular, linear guide system for a push-in element of a furniture item, wherein the guide system has a cabinet rail, a push-in element rail which is configured for connection to the push-in element, and a central rail present between the cabinet rail and the push-in element rail, wherein, for the relative movement between the rails, there is a bearing arrangement between portions of the cabinet rail and the central rail and a bearing arrangement between portions of the central rail and the push-in element rail, wherein the cabinet rail is configured as a guide rail according to one of the above-described developments.

An advantageous full-extension mechanism is therefore provided, i.e. a rail guide with a central rail between the cabinet rail and the push-in element rail. The central rail is preferably configured symmetrically, preferably configured as a closed hollow body with oblique transitions on the upper side and underside between a respective rectilinear vertical sidewall of the central rail and a horizontal upper side and/or underside of the central rail. Correspondingly, the cabinet rail and the push-in element rail preferably have oblique longitudinal edges.

The guide system is advantageously configured as an undermount guide system, wherein the push-in element rail is configured such that an underside of a base of the push-in element can be supported on the push-in element rail in the state of use of the guide system. A guide system is therefore provided which requires little construction space in the width direction in the furniture item. A distance between an outer face of the drawer and the inner face of a sidewall of the furniture cabinet can be minimized since essentially only the width of the mounting portion of the fastening element has to be taken into consideration there.

Finally, the present invention is directed toward a furniture item comprising a cabinet and a push-in element, wherein the push-in element is accommodated movably in the cabinet by way of a guide system, wherein a guide system is present for the push-in element as described previously. Preferably precisely two guide systems are present, in each case laterally, on the push-in element, such as a drawer.

The furniture item preferably has a forwardly open, box-like cabinet in which there is one drawer or a plurality of drawers one above another that are each movably guided by rails.

The guide system is configured as a partial-extension or full-extension mechanism. The guide system is preferably configured as an undermount guide. In this case, an underside of the furniture part is supported on an upper side of a respective movement rail of the two parallel guide systems.

In an advantageous manner, there is a push-in element rail on which the push-in element can be arranged in the state of use of the guide system, wherein the push-in element rail has a positioning portion which is configured protruding to an outer side of the push-in element rail and which is configured to predetermine a functionally correct relative position between the push-in element and the push-in element rail, in the state of use of the guide system. The positionally correct mounting of the push-in element on the guide system, for example, in the lateral direction or in a direction transversely with respect to the push-in element, when the guide system is mounted, for example, on the cabinet of a furniture item, can therefore advantageously be permitted. The positioning portion comes into action at the end of an installation pushing-on movement of the push-in element on the push-in element rail until the push-in element has been positionally correctly mounted on the push-in element rail. The positioning portion is coordinated such as to match a mating portion on the push-in element, such as on a drawer. The mating portion is, for example, a portion on a wall portion of the push-in element, such as, for example, on a rear wall portion. The wall portion is formed, for example, vertically parallel to a sidewall of the push-in element. When the push-in element is mounted on the furniture item or domestic appliance, with the guide system fastened to the cabinet and with the push-in element rail extended, the push-in element is placed from above onto the push-in element rail and pushed to the rear on the push-in element rail. As a rule, two identical guide systems are provided on the cabinet, and therefore the push-in element can be supported on two parallel push-in element rails on the cabinet. The positioning portion comes into contact here with the mating portion on the push-in element, in the state of use of the guide system. The positioning portion serves, in particular, as a mounting or retraction aid during the installation of the push-in element on the guide system. The positioning portion preferably serves for positioning the push-in element laterally or correctly in the direction transversely with respect to the longitudinal direction of the guide system relative to the push-in element rail, the position of which is fixed when the guide system is mounted on the cabinet, as a result of which the correct relative position of the push-in element with respect to the cabinet is predetermined.

The positioning portion protrudes, for example, relative to the remaining portions of a vertically oriented inner sidewall of the push-in element rail. The positioning portion is configured or is present in a rearward or rear end portion of the push-in element rail. When, for example, the push-in element is pushed from the front on the push-in element rail, first of all a, for example, inclined or obliquely oriented ramp portion of the positioning portion comes into contact with a mating portion of the push-in element in such a manner that, when the push-in element is pushed on further to the rear in the longitudinal direction of the push-in element rail, the push-in element is offset laterally relative to the laterally positionally fixed push-in element rail and thus passes into the correct lateral position with respect to the push-in element rail until the end position of the push-in element in the longitudinal direction of the push-in element rail is reached. A contact portion of the positioning portion that is at an angle with respect to the ramp portion comes into contact here with the mating portion of the push-in element. The end position of the push-in element in the longitudinal direction of the push-in element rail is predetermined, for example, by a further stop, such as a hook element protruding on the upper side on an upper side of the push-in element rail, on the push-in element rail. The hook element engages, for example, in a provided opening on a rear side of a rear wall of the push-in element.

Finally, a furniture item is proposed which has a guide system as described above. The furniture item has, for example, a plurality of drawers one above another.

BRIEF DESCRIPTION OF THE DRAWINGS

Further features and advantages of the present invention are explained in more detail with reference to the exemplary embodiments of the present invention that are illustrated in the figures. Corresponding elements of different exemplary embodiments are sometimes provided with the same reference signs.

DETAILED DESCRIPTION OF THE INVENTION

Figure 1:
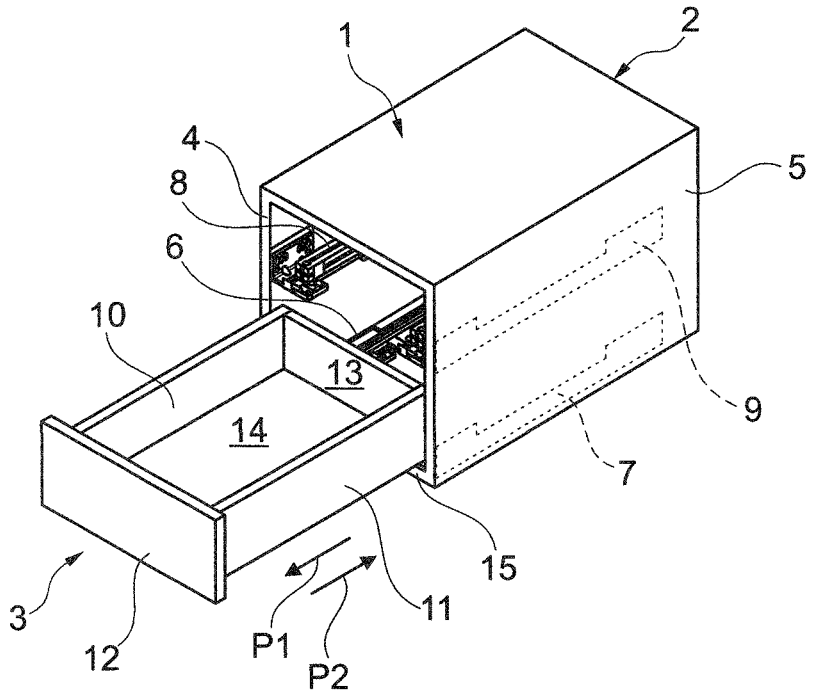
FIG. 1 shows a schematically depicted furniture item according to the present invention in a perspective view obliquely from above, with a drawer received displaceably thereon in an extended position.
Figure 3:
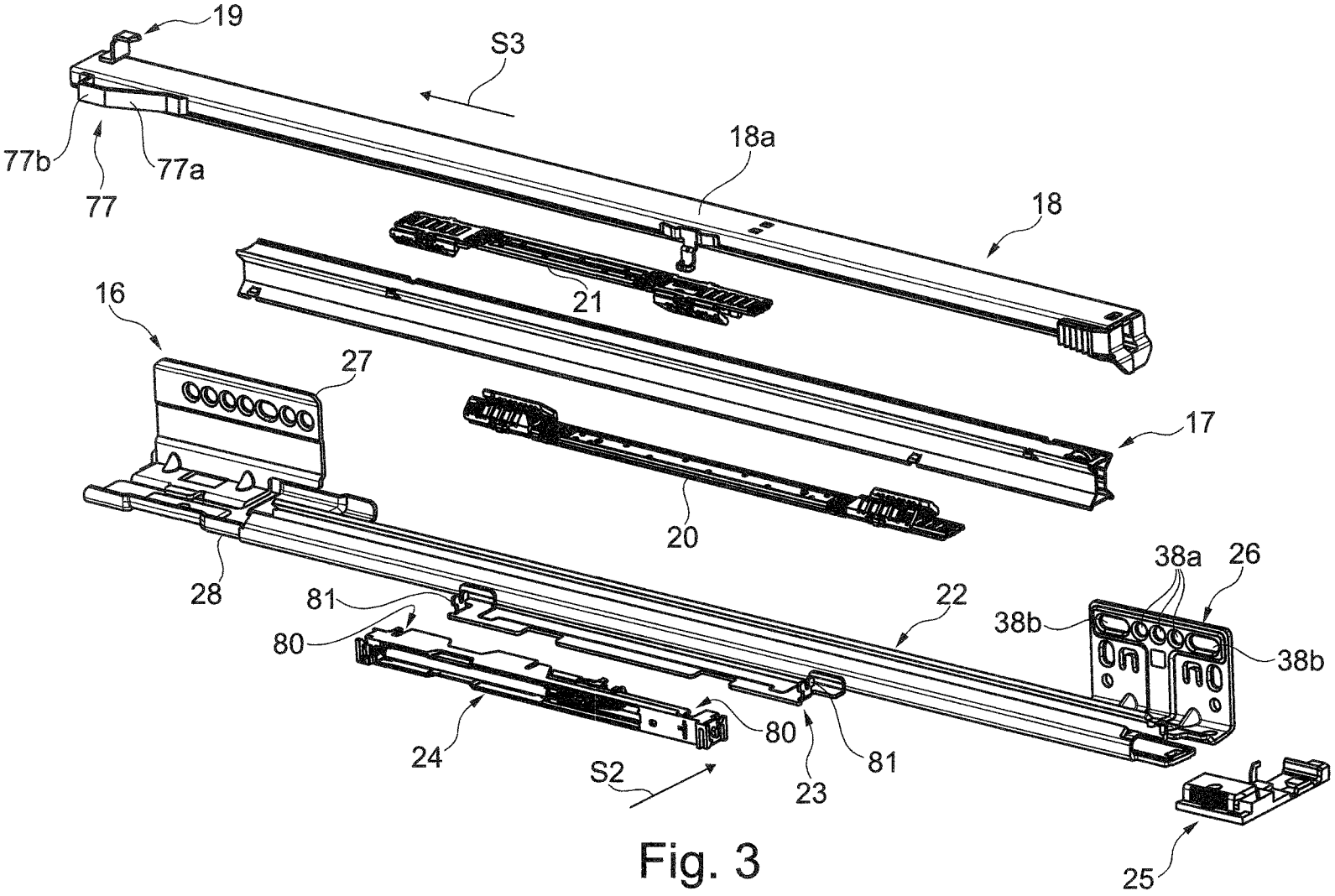
FIG. 3 shows the guide system according to the present invention from FIG. 2 partially in an exploded illustration.

FIG. 1 shows a highly schematic depiction of a furniture item 1 according to the present invention in a state of use, with a hollow cuboid furniture cabinet 2 and a push-in element configured as a drawer 3, wherein the drawer 3 is received displaceably on the furniture cabinet 2, with two identical structural units of a guide system according to the present invention. FIG. 3 shows a structural unit in an exploded illustration. The furniture cabinet 2 comprises two opposite vertical sidewalls 4 and 5 between which the drawer 3, starting from a state of accommodation in the interior of the furniture cabinet 2, can be pulled out from the furniture cabinet 2 in the horizontal direction according to P1 and then pushed in in an opposite direction according to P2 via a guide system according to the present invention with telescopic guide means or with a first rail full-extension mechanism 6 and a second rail full-extension mechanism 7. The drawer 3 is shown in FIG. 1 in the state when moved out to the maximum extent or completely from the interior of the furniture cabinet 2. The storage volume of the drawer 3 can thus be accessed virtually unimpeded from above.

The rail full-extension mechanism 6 screwed onto the inner face of the sidewall 4 is located opposite, and at the same vertical height as, the rail full-extension mechanism 7 which is screwed onto the sidewall 5, is concealed in FIG. 1 and is indicated by broken lines.

A further drawer (not illustrated in FIG. 1), guided correspondingly by way of rail full-extension mechanisms 8 and 9, can be accommodated in the furniture cabinet 2 above the drawer 3. The drawer 3 has mutually opposite drawer sidewalls 10, 11. In addition, the drawer 3 comprises a front element 12, a rear wall 13 lying horizontally opposite the latter, and a horizontally extending drawer base 14, which reaches as far as and is connected to the drawer sidewalls 10, 11, the front element 12 and the rear wall 13.

Figure 2:
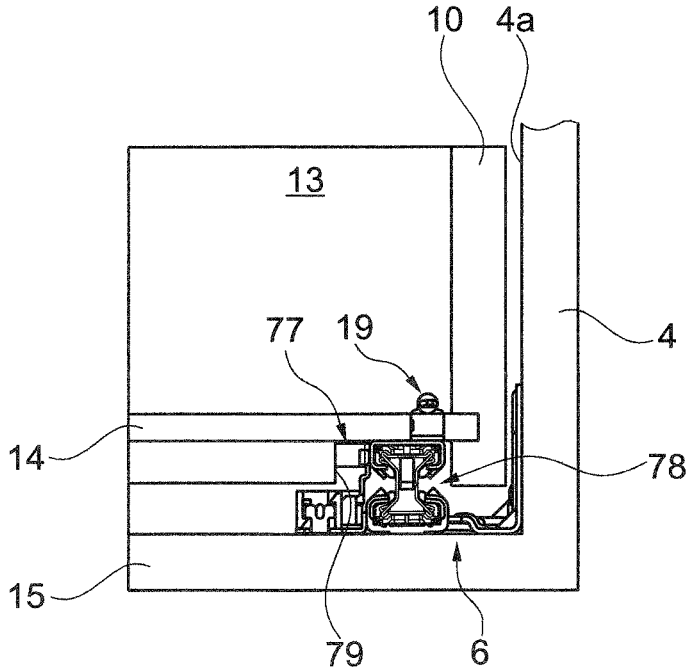
FIG. 2 shows a bottom right detail of the furniture item according to FIG. 1 from the rear or in a rear view.

FIG. 2 shows the situation according to FIG. 1 in a section through the furniture cabinet 2, transversely with respect to the length of the rail full-extension mechanism 6 in the region of the right cabinet sidewall 4, as viewed from the rear. The region shows a cabinet base 15, a detail of the drawer 3 with the drawer base 14, the drawer sidewall 10 and the rear wall 13. The drawer 3 is received on the furniture cabinet 2 via two structural units of a guide system according to the present invention, of which the rail full-extension mechanism 6 according to the present invention is fastened to the sidewall 4. On the other or left side, the drawer 3 is received in the same way on the sidewall 5 (not visible in FIG. 2) by way of the further drawer sidewall 11 via the further rail full-extension mechanism 7.

The rail full-extension mechanism 6 and 7 according to the present invention formed as a structural unit of the guide system are configured as undermount guide, which FIG. 2 shows, by which the undermount guide or the rail full-extension mechanism 6 is positioned below the drawer base 14. The rail full-extension mechanism 6 or 7 comprises three guide rails, or a cabinet rail 16, a central rail 17 and a push-in element 18, which are telescopic with respect to one another.

The central rail 17 is configured, for example, as a hollow profile closed circumferentially on the longitudinal side.

A push-in element which is to be moved, such as the drawer 3, is coupled or connected to the push-in element rail 18 by the drawer base 14 or the underside thereof being supported on top of an upper side 18*a* of the push-in element rail 18.

The cabinet rail 16 is spaced apart at the bottom slightly from the cabinet base 15 and is connected to the sidewall 4 according to FIG. 2 by being screwed fixedly thereto.

As, for example, FIGS. 2 and 3 show, a hook element 19 which is present at the rear end of the push-in element rail 18 and protrudes upward forms a stop for a portion of the rear wall 13 of the drawer 3, wherein, for the precise positioning, a portion of the hook element 19 that is angled parallel to the upper side 18*a* engages in a prepared depression matching it in the rear wall 13 of the drawer 3. The hook element 19 protrudes at the top on the upper side 18*a* of the push-in element rail 18 which serves for supporting the underside of the base 14.

On the push-in element rail 18, there is a positioning portion 77 which is formed protruding with respect to a vertical outer face on the inner face of the push-in element rail 18 and has a ramp portion 77*a* and a contact portion 77*b*. The positioning portion 77 serves for easily pushing on the drawer during the initial installation. In addition, the positioning portion 77 predetermines a functionally correct relative position between the drawer 3 and the push-in element rail 18, in the state of use of the rail full-extension mechanism 6. This can advantageously permit the fine adjustment of the drawer 3 or positionally correct mounting of the drawer 3 on the rail full-extension mechanism 6, for example, in the lateral direction or in a direction transversely with respect to the length of the push-in element rail 18, with the latter being mounted on the cabinet 2 of the furniture item 1 during the installation. The rear wall 13 has, for example, a cutout 78 with a vertical mating portion 79. When the drawer 3, which is virtually correctly oriented laterally with respect to the push-in element rail 13, is pushed on with the rear wall 13 in front in the direction S3, the positioning portion 77 comes into action. The underside of the drawer base 14 is supported here on the upper side 18*a*. Toward the end of the pushing-on movement, when the drawer 3 is located laterally somewhat too close to the sidewall 4 of the furniture cabinet 2, a rear vertical edge on the mating portion 79 first of all comes into contact with the ramp portion 77*a* and, upon further pushing on of the drawer 3 in the direction S3, is offset laterally until into the correct side position relative to the push-in element rail 13. In the final installation position of the drawer 3, the contact portion 77*b* is then present at the mating portion 79, which FIG. 2 clarifies.

In addition, the full-extension mechanism 6 comprises a first or lower carriage 20 with bearing bodies arranged thereon, wherein the carriage 20 between the cabinet rail 16 and the central rail 17 ensures a load-transmitting relative movement of the rails 16, 17.

Furthermore, the full-extension mechanism 6 comprises a second or upper carriage 21 with bearing bodies arranged thereon, wherein the upper carriage 21 between the central rail 18 and the push-in element rail 18 ensures a load-transmitting relative movement of the rails 17, 18.

The length of the carriages 20 and 21 may be different, as compared with each other. However, it is also conceivable for the length of the carriage 20 to be identical to the length of the carriage 21 or for the two carriages 20 and 21 to have the same length.

A receptacle 23 is present on a vertical, inwardly facing narrow side of a rail body 22 of the cabinet rail 16, by way of which receptacle a movement mechanism 24 of the rail full-extension mechanism 6 can be attached, wherein the movement mechanism 24 is configured, for example, for supporting an ejection movement and/or a retraction movement of the drawer 3. The movement mechanism 24 is, for example, a universally configured component which is usable for different guide systems and can be arranged thereon in a respective orientation. In the present exemplary embodiment, the movement mechanism 24 is moved with a side, on which notches 80 for latching are provided, in front according to the plug-on direction S2 in the direction of the receptacle 23 and plugged thereon. In the process, the two notches 80 latch on latching wings 81 matched thereto. The movement mechanism 24, rotated by 90 angular degrees about its longitudinal axis, can alternatively be attached to another guide system, for example, by way of two pins protruding on the rail body associated therewith perpendicularly to a vertical inner face.

In addition, a depth adjustment element 25 is provided at the front of the cabinet rail 16.

Two approximately L-shaped fastening elements or a front fastening element 26 and a rear fastening element 27 belong to the cabinet rail 16. The fastening elements 26, 27 serve to fasten or fix the rail full-extension mechanism 6 on a mating portion, for example, on an inner face 4*a* of the sidewall 4 of the furniture cabinet 2 (see FIG. 2).

The guide rails 16-18 are preferably made of a sheet metal material which, starting from the flat sheet metal material, is shaped, for example, by a punching and bending process, in order to give the end product of the respective guide rail.

The hollow profile form of the central rail 17 that is closed circumferentially for example by laser welding makes it possible for the central rail 17 to be mechanically highly stable, in particular flexurally and torsionally rigid.

The fastening element 26 is connected to the rail body 22 by cohesive bonding, preferably is welded thereto, or is connected by a welding process, such as, for example, a laser welding process.

Figure 13A:
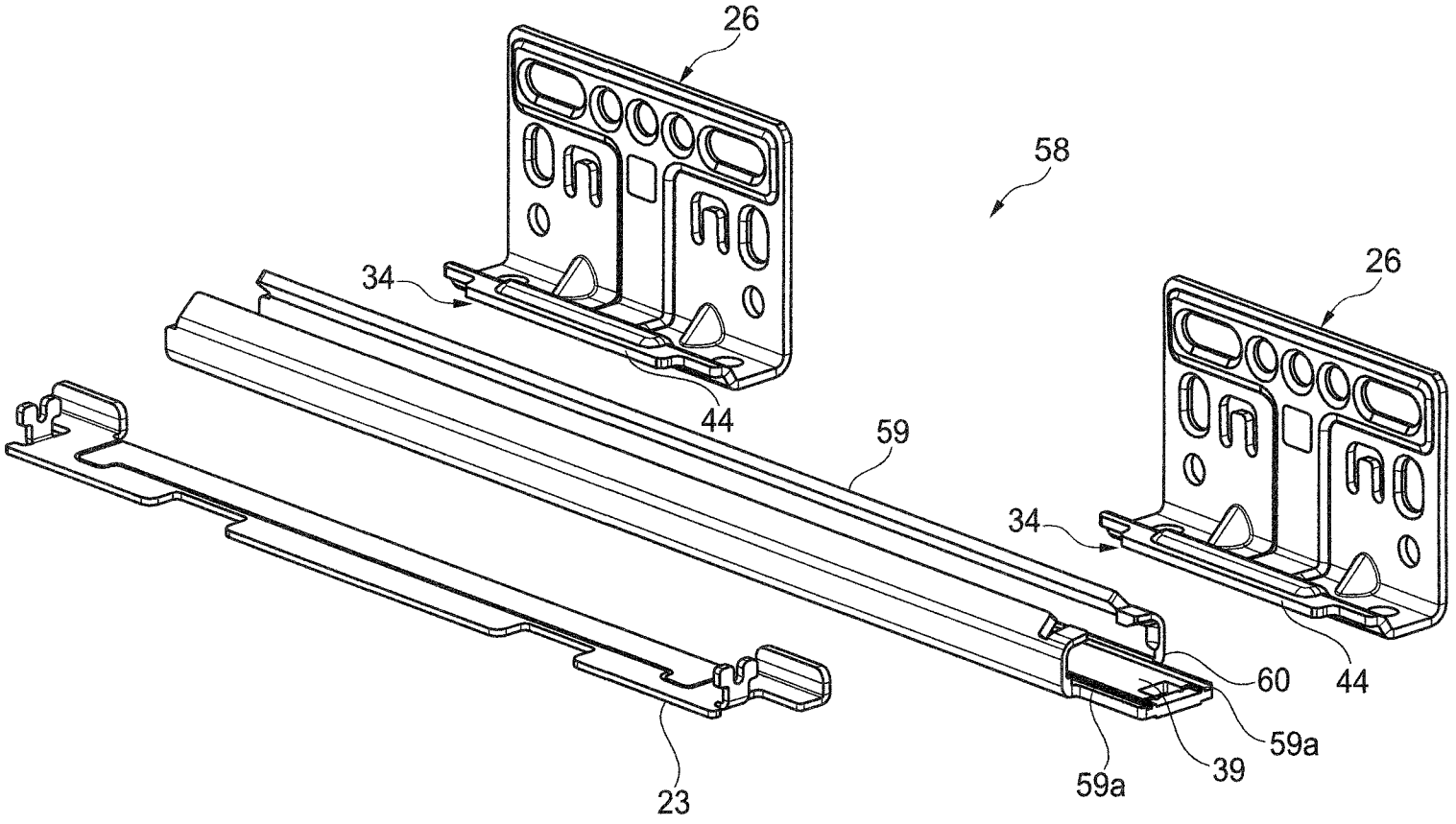
FIG. 13A shows an alternative guide rail in an exploded view.

In the exemplary embodiment according to FIG. 13A, there are precisely two identical fastening elements 26 present on the rail body 59 of an associated guide rail 58 which forms a cabinet rail. The basic shape of the fastening elements 26 is an L shape.

Figure 4A:
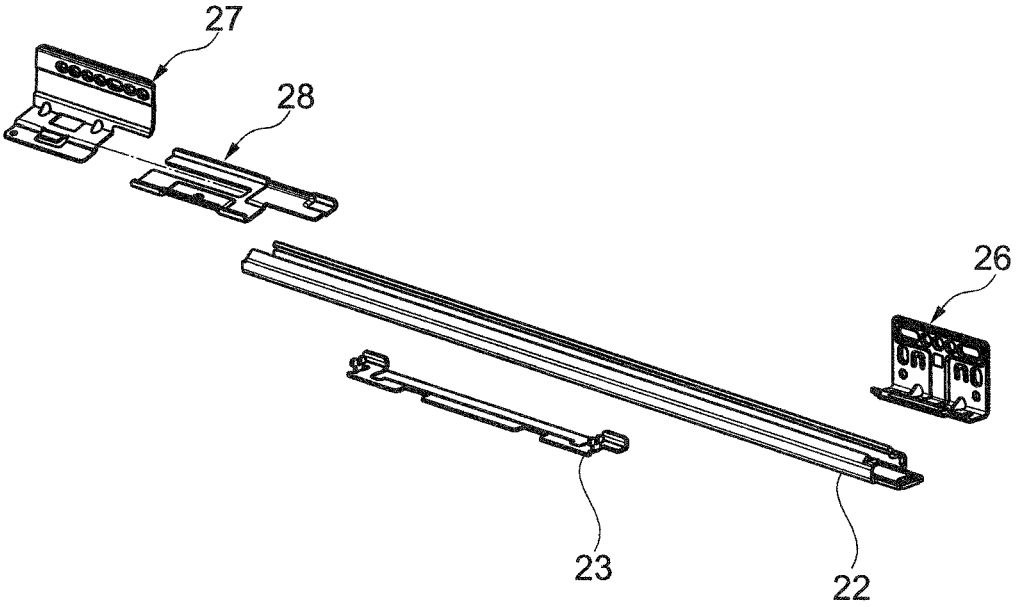
FIG. 4A shows the individual elements of a cabinet rail, shown in FIG. 3, in an exploded illustration.
Figure 4B:
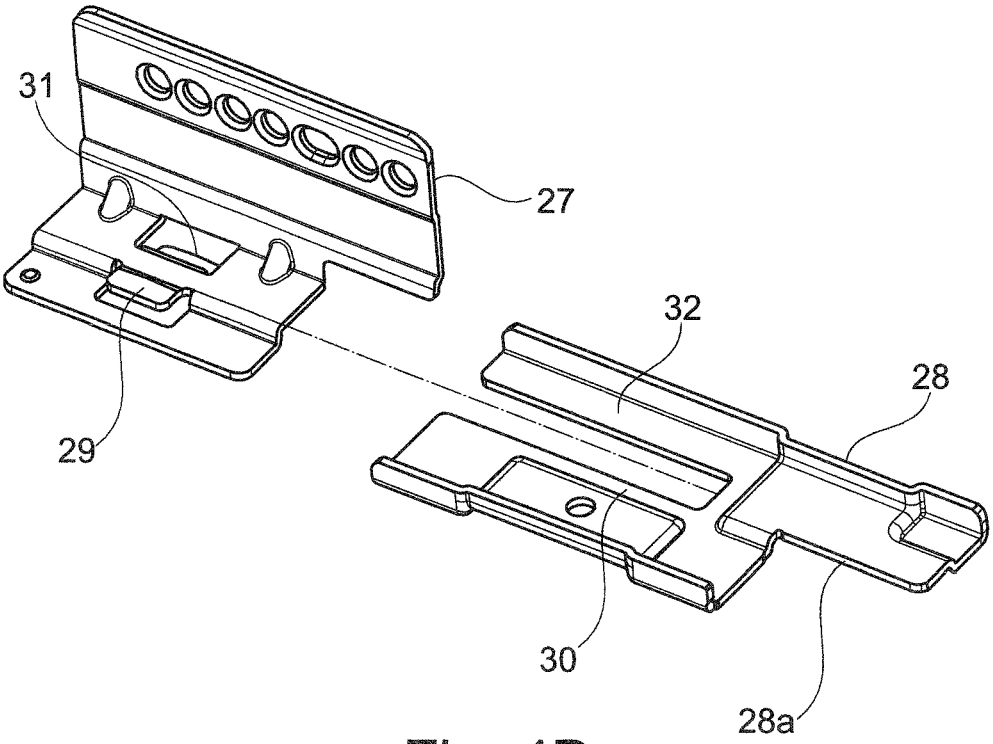
FIG. 4B shows two elements, which are shown in FIG. 4A, on an enlarged scale.

The basic shape of the fastening element 27 is also an L shape with a vertical limb and a horizontal limb having a centrally extending longitudinal shoulder and is mounted, for example, releasably on an attachment piece 28, for example, can be attached by pushing on a rear front face of the attachment piece 28 (see FIG. 4B). In the process, an angled tab 29 of the fastening element 27, which tab engages on the horizontal limb in the region of the longitudinal shoulder and protrudes upward thereon, engages in a clamping manner over a flat portion 30 on the attachment piece 28. A further, downwardly protruding angled tab 31 of the fastening element 27 engages in a clamping manner below a flat portion 32 on the attachment piece 28. The two portions 30 and 32 are separated or spaced apart in the width direction flush at one height by a central incision, for example, a material recess, which is open to the rear end and is right-angled in top view.

The attachment piece 28 has an edge portion 28*a*, for example, over a partial length, wherein the edge portion 28*a* of the attachment piece 28 abuts the surface side 33 at the rear of the rail body 22, for example is laser welded thereto. The fastening element 27 is screwed, for example, to the furniture cabinet, for example, to an inner face of a sidewall, for which purpose there are a plurality of round mounting holes and, for example, an elongated hole in the vertical limb of the fastening element 27, and then the remaining guide rail is mounted attached from the front or attached to the attachment piece 28. A cabinet rail 16 according to FIG. 4C differs from the cabinet rail 16 according to FIG. 4A in that, instead of the fastening element 27, a mounting element 61 with a horizontal limb 62 and a vertical limb 63 is provided. The mounting element 61 is configured, for example, as an angled sheet formed, for example, from a metal material. A plurality of horizontally oriented elongated holes and a plurality of, for example, two vertically oriented parallel elongated holes and a plurality of round screwing-on holes for fastening to, for example, a rear wall of a furniture cabinet are formed in the vertical limb 63. For the attachment and firm clamping of the rearward end portion of the attachment piece 28, which is provided at the rear of the rail body 22, for example, by pushing on in direction S1, the horizontal limb 62 is provided with two opposite L-shaped clamping portions 64 and 65 which protrude upward on an upper side of the horizontal limb 62 and are spaced apart transversely with respect to the longitudinal direction of the rail body 22. In the connected state of attachment piece 28 and mounting element 61, a region of the portion 30 of the attachment piece 28 or regions adjoining the portions are held clamped between a horizontally running upper part of the clamping portion 64 and the upper side of the horizontal limb 62. In a corresponding manner, in the connected state of attachment piece 28 and mounting element 61, a region of the portion 32 of the attachment piece 28 or regions adjoining the portion are held clamped between a horizontally running upper part of the clamping portion 65 and the upper side of the horizontal limb 62. The cabinet rail 16 can, therefore, be fixed at the rear, for example, to a rear wall of the furniture cabinet, and held transversely with respect to the longitudinal axis of the cabinet rail 16 without lateral play or in a fixed transverse position. Accordingly, the cabinet rail which is fastened to the furniture cabinet runs, for example, horizontally and parallel to the cabinet sidewall. In the longitudinal direction of the cabinet rail 16, the position of the remaining rail body 22 with the attachment piece 28 is variable relative to the mounting element 61 over the length of the horizontal limb 62.

Figure 4C:
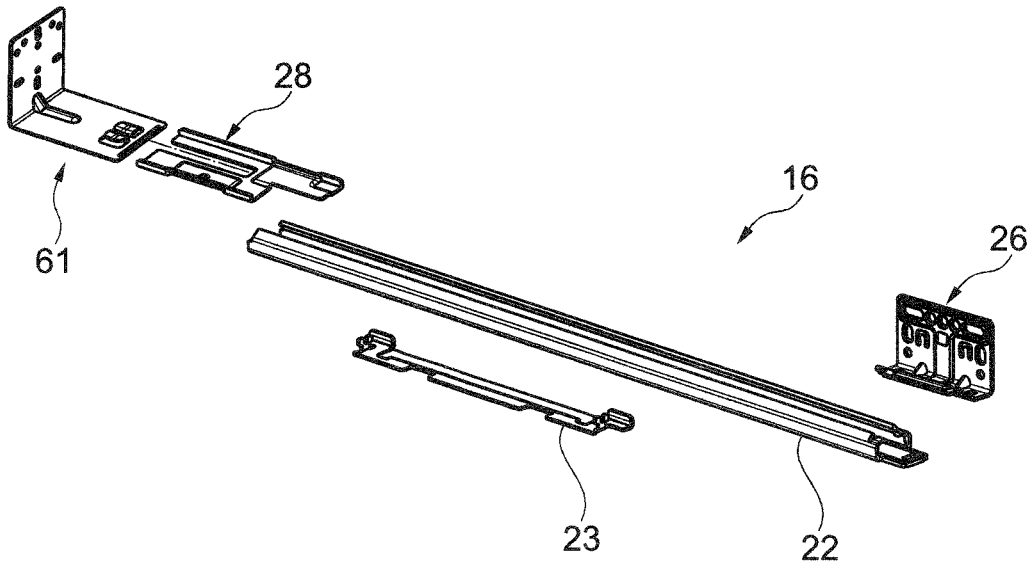
FIG. 4C shows the individual elements of an alternative cabinet rail in an exploded illustration.
Figure 4D:
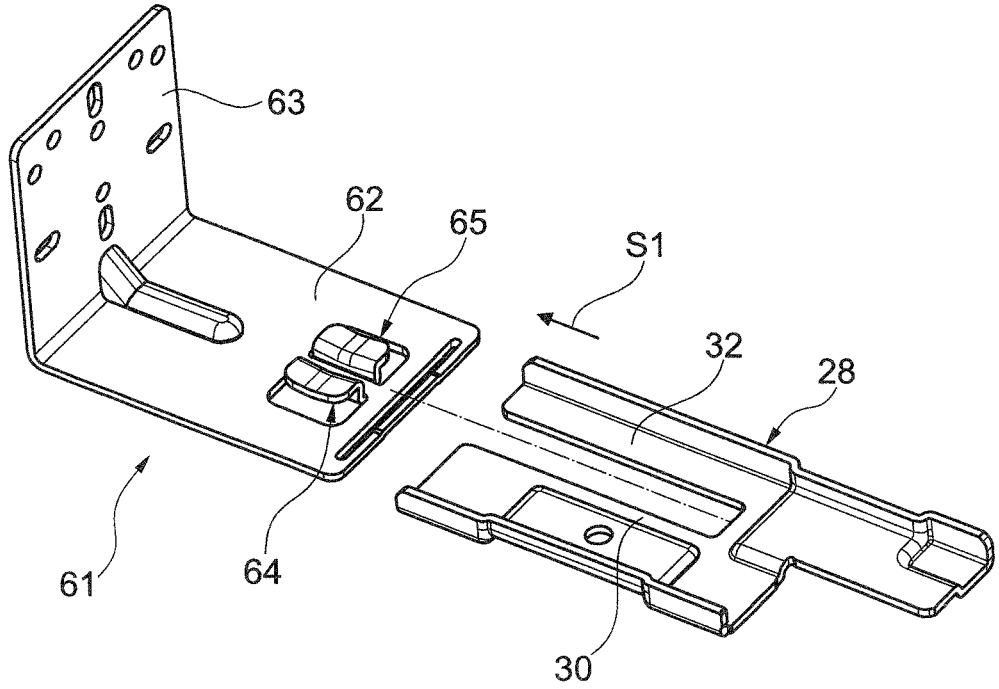
FIG. 4D shows two elements, which are shown in FIG. 4C, on an enlarged scale.
Figure 4E:
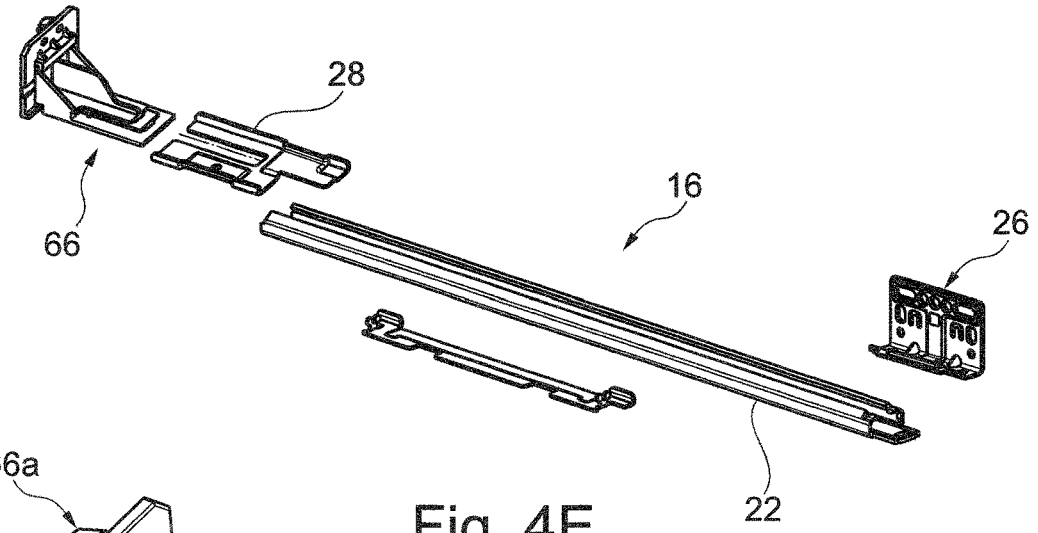
FIG. 4E shows a further alternative cabinet rail in an exploded illustration.
Figure 4F:
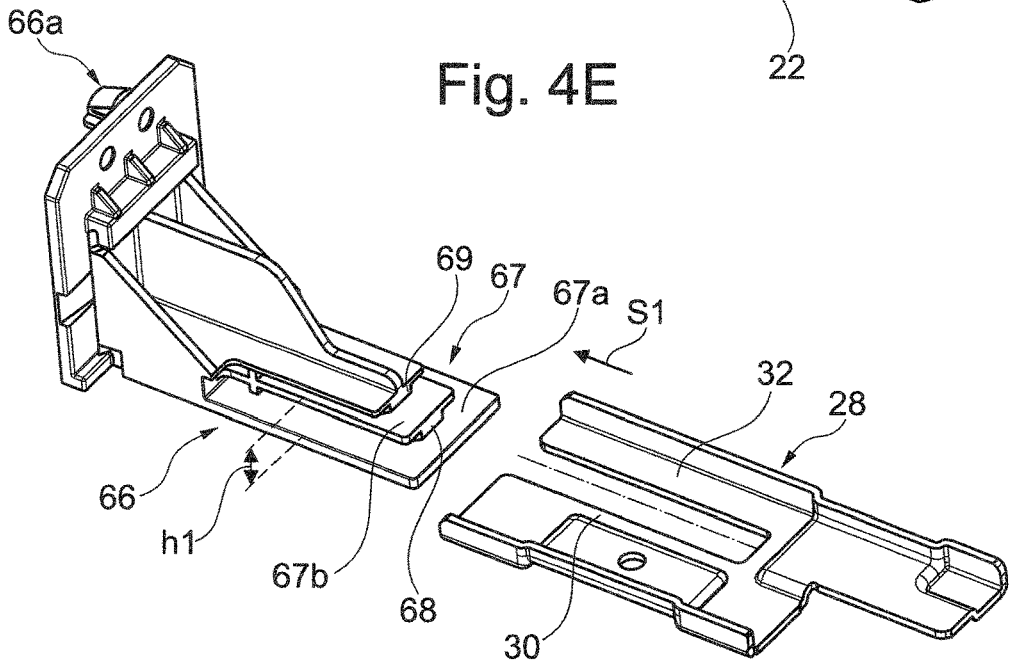
FIG. 4F shows two elements, which are shown in FIG. 4E, on an enlarged scale.

A cabinet rail 16 according to FIG. 4E, 4F, as an alternative to the cabinet rail 16 according to FIG. 4C, 4D, differs from the configuration according to FIG. 4B, 4C by an alternative mounting element 66 to the mounting element 61. The mounting element 66 is composed, for example, of plastic and can be screwed to a rear wall of a furniture cabinet and/or can be inserted into a, for example, matching opening which is provided in the rear wall of a furniture cabinet via a plug-in projection 66*a* of the mounting element 66, the plug-in projection protruding rearward at the rear of an otherwise plane rear side of the mounting element 66, and can be fixed, for example, by clamping. The attachment piece 28 can be pushed on the mounting element 66 from the front. The attachment and firm clamping of the rearward end portion of the attachment piece 28, which is provided at the rear of the rail body 22, is undertaken, for example, by pushing on in direction S1. The attachment piece 28 can be attached by, for example, a fitter to the mounting element 66 at, for example, two different provided positions, for example, according to choice. The different positions differ in a vertical position with respect to a direction perpendicular to a flat upper side of a horizontal limb 67. In a first position in which the attachment piece 28 is pushed on and fastened to the horizontal limb 67, respective undersides of the portion 30 of the attachment piece 28 or regions adjoining the portion are supported on a first upper side 67*a* of the horizontal limb 67. In a different or second position which is located higher than the first position and in which the attachment piece 28 when pushed on can be fastened to the horizontal limb 67, respective undersides of the portions 30 and 32 of the attachment piece 28 or regions adjoining the portions are supported on a second upper side 67*b* of the horizontal limb 67. A height difference hl between the two sides 67*a* and 67*b* oriented parallel is, for example, one, two, three or more millimeters, for example, in a direction perpendicular to the side 67*a*. The horizontal limb 67 is provided with elongate webs 68, 69 which are central with respect to the width transversely with respect to the longitudinal direction of the cabinet rail 16 and lie one above the other. On both sides of the lower web 68, two longitudinal slots which are open on the outside over their length and are bounded downward by the side 67*a* are formed along or laterally adjoining the web 68 by means of respective material strips which protrude above and laterally on both sides of the web 68 and belong to the side 67*b*.

Similarly, two longitudinal slots which are bounded at the bottom by the side 67*b* and adjoin along the web 69 or at the webs 69 are formed on both sides of the web 69 by respective lateral material strips protruding above and laterally horizontally at the web 69.

The identical width of the strip-shaped webs 68, 69 is coordinated with the width of the strip-shaped material recess at the rear end of the attachment piece 28 between the two portions 30 and 32 or is slightly smaller than the width of the strip-shaped material recess. The slot height of the longitudinal slots is identical, wherein the sheet-like or plate-like portions 30 and 32 can be pushed into the longitudinal slots from the front with slight rubbing. The cabinet rail 16 can therefore be fastened releasably in two different height positions to the mounting element 66 and, therefore, relative, for example, to the furniture cabinet rear wall.

Figure 5A:
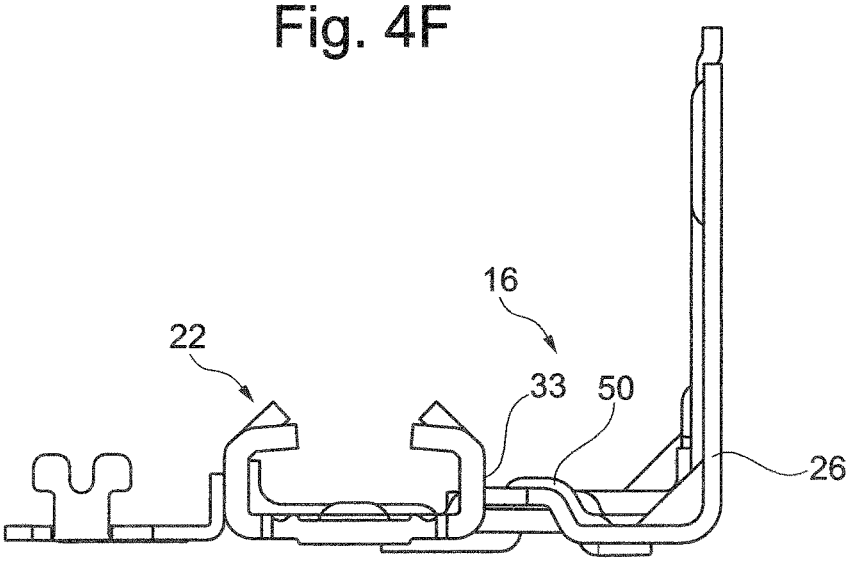
FIG. 5A shows the cabinet rail, which is shown in FIG. 4A, in assembled form in an end view from the front.
Figure 5B:
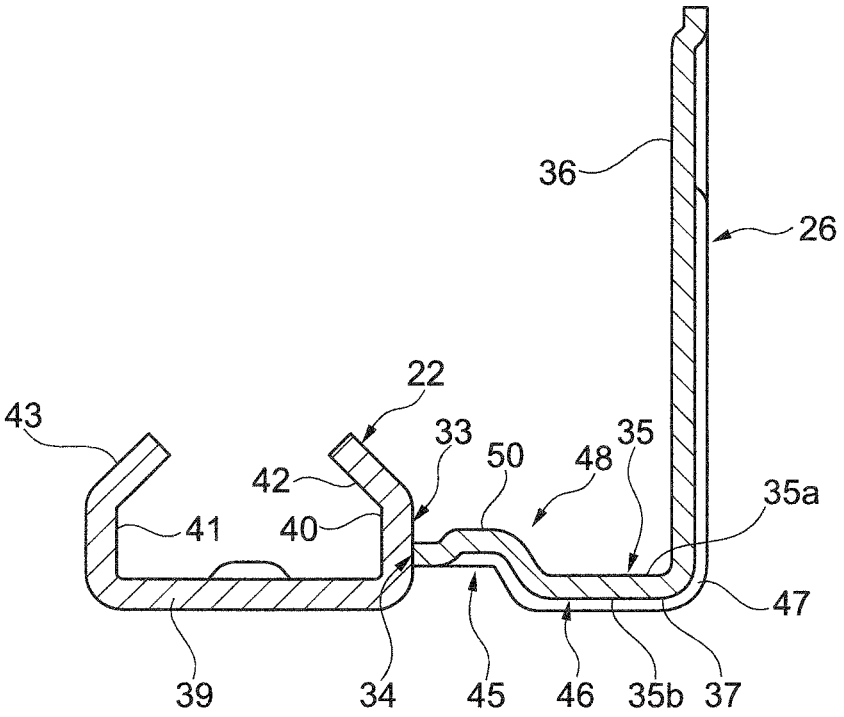
FIG. 5B shows the cabinet rail according to FIG. 5A in a section in the region of a front fastening element.
Figure 5C:
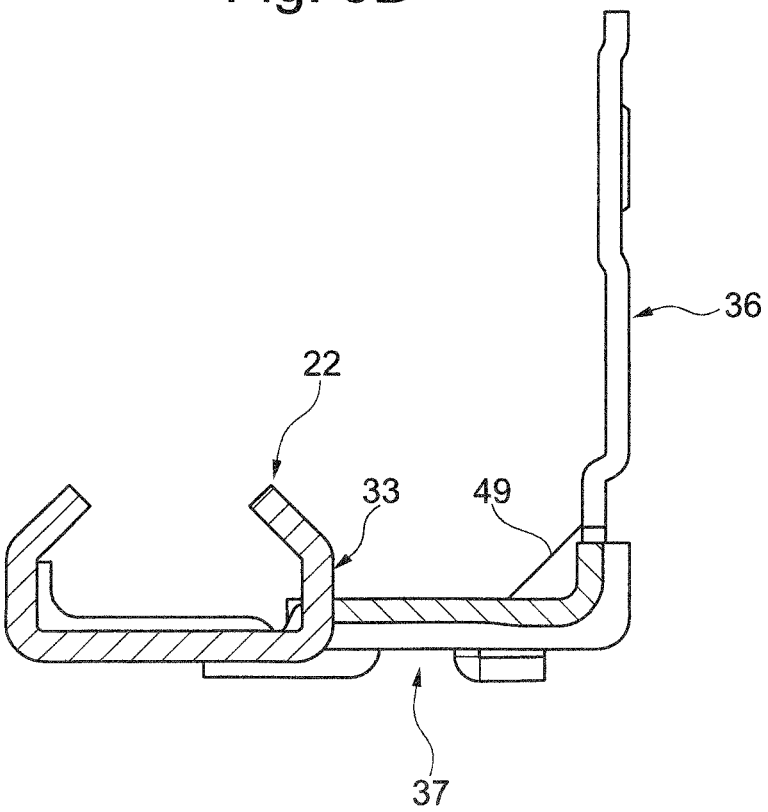
FIG. 5C shows the cabinet rail according to FIG. 5A in a section in the region of a rear fastening element.
Figure 6A:
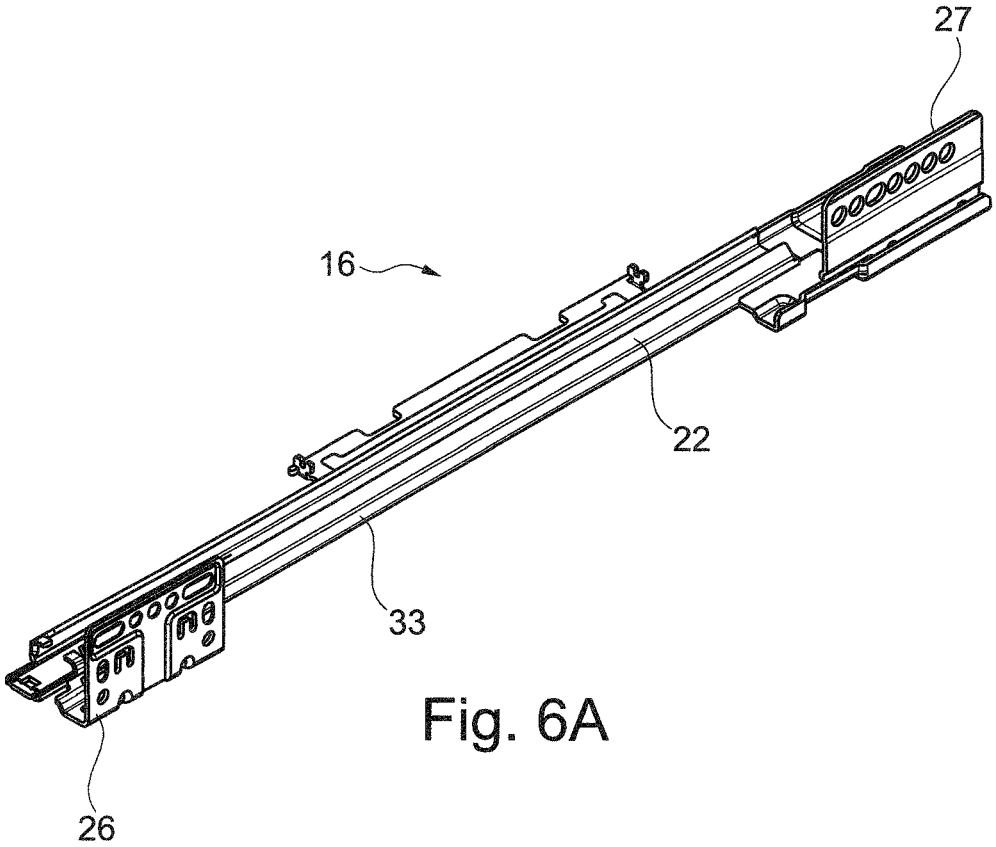
FIG. 6A shows a perspective view of the assembled guide rail according to the elements from FIG. 4A obliquely from above.
Figure 6B:
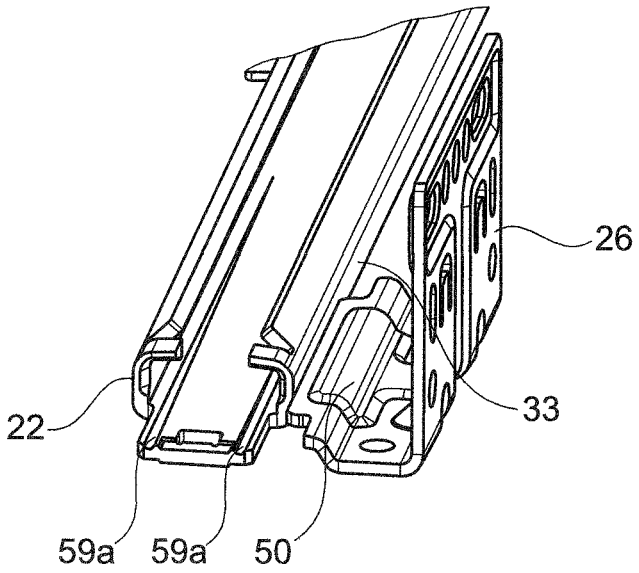
FIG. 6B shows a perspective view of a front end portion of the guide rail according to FIG. 6A from the front.
Figure 7:
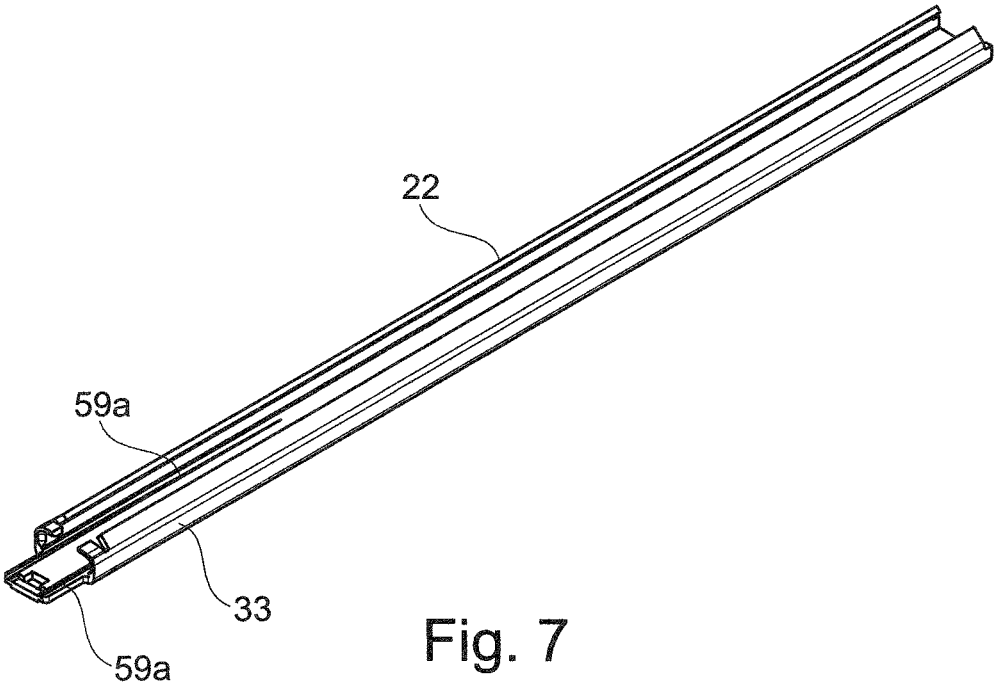
FIG. 7 shows a perspective view of a rail body of the cabinet rail shown in FIGS. 3, 4A and 6A obliquely from above.
Figure 8:
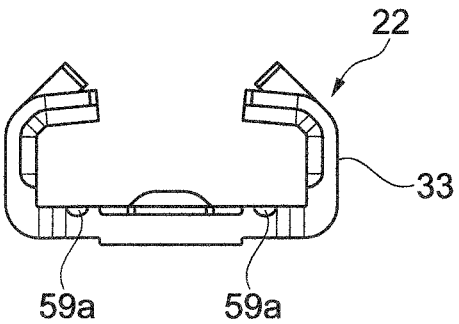
FIG. 8 shows the rail body according to FIG. 7 in an end view from the front.
Figure 9:
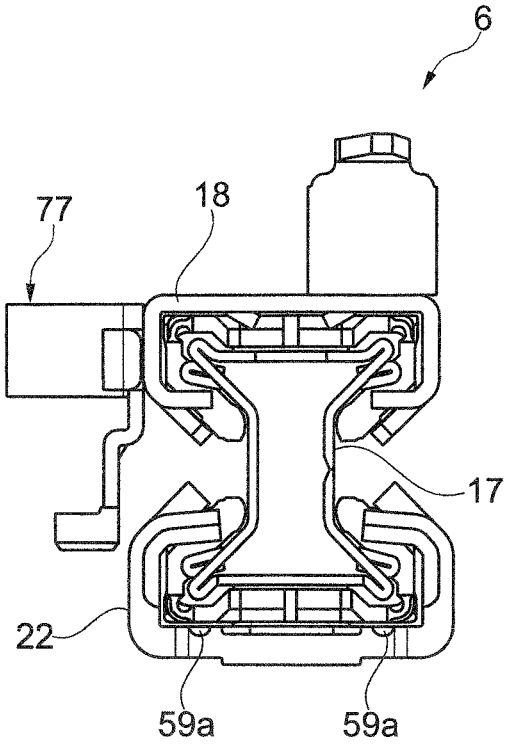
FIG. 9 shows an arrangement based on the guide system according to FIG. 3 from the front in the assembled state without fastening elements.

An abutting connection of the fastening element 26 to a vertical or upright surface side 33 of the rail body 22 or to an outer surface side 60 of a rail body 59 by means of a welded connection takes place via a narrow front edge portion 34 on the fastening element 26 (see FIGS. 5B, 13A).

The two-limbed or L-shaped fastening element 26 has a flat material portion 35 with opposite main sides 35*a* and 35*b* and the edge portion 34 between the main sides 35*a*, 35*b*. In the state of use, the fastening element 26 comprises a vertical limb 36 and a horizontal limb 37 which extends in the horizontal direction and is formed from the flat material portion 35. The vertical limb 36 and the horizontal limb 37 are at right angles or at an angle of 90 angular degrees to each other.

In the upper portion of the vertical limb 36 of the fastening element 26 there are a plurality of, for example, three, circular mounting holes 38*a* positioned next to one another over the longitudinal extent of the fastening element 26, for example, screw holes, and two elongated holes 38*b* which adjoin the mounting holes at the front and rear, extend in the longitudinal direction and between which the mounting holes 38*a* are present. The mounting holes 38*a* and/or the elongated holes 38*b* serve to screw the rail full-extension mechanism 6 or the cabinet rail 16 to a mating portion, for example, to the vertical sidewall 4 of the furniture cabinet 2.

The rail body 22 comprises a base 39 and vertical sides 40 and 41, which are angled upwards at a right angle along both longitudinal sides of the base 39 in cross section, and longitudinal webs 42, 43 which are each oriented angled inward at the upper end of the associated side 40 and 41 (see FIG. 5B).

A contact surface 44 is provided by the plane edge portion 34 which is at the end of the horizontal limb 37 and is strip-shaped in top view, on the fastening element 26, the edge portion being formed at the edge of a free edge of an outer limb portion 45 of the horizontal limb 37 (see FIG. 13A). In the case of the fastening element 26, a fixed connection, for example, laser welded connection, is formed between the surface side 33 or 60 of the rail body 22 or 59 and the contact surface 44.

The fastening element 26 is, therefore, connected by the edge portion 34 to the rail body 22 or 59 and the surface side 33 or 60 thereof via a flat cohesively bonded connection.

The horizontal limb 37 also comprises an inner limb portion 46 between a bending edge 47 of the fastening element 26 and a shoulder 48 of the horizontal limb 37.

In order to reinforce the fastening element 26, reinforcing mechanisms with an arch 50 are formed on the fastening element 26. In addition, two mechanically stabilizing ribs 49 are formed in the region of the bending edge 47.

The arch 50 has a uniform height, for example, over its entire extent, and forms a plane upper side and a plane underside with a bent edge of the arch 50. The height of the arch 50 with respect to non-stamped, plane portions of the fastening element 26 is, for example, in the millimeter range, with respect to a distance of an upper side of the arch 50 to an upper side of the sheet metal material of the fastening element 26 that has not been deformed in an arched manner. The height of the arch 50 corresponds, for example, to half the sheet metal thickness of the sheet metal material of the fastening element 26 and is, for example, circa 1 or 2 millimeters for each sheet metal material of a thickness of 2 or 4 millimeters. The arch 50 is raised on an upper side of the fastening element 26 or formed as an elevation with respect to the state of use and with respect to adjacent adjoining portions of the fastening element 26. The arch 50 is recessed on an underside of the fastening element 26 or formed as a depression or trough with respect to the state of use and with respect to adjacent adjoining portions of the fastening element 26.

The arch 50 extends continuously from the outer limb portion 45 over the shoulder 48 to the inner limb portion 46, over the bending edge 47 as far as the vertical limb 36, and over the height thereof as far as the mounting holes 38. The arch 50 extends, for example, over all of the mounting holes 38.

The size or the length of the arch 50 in the longitudinal direction of the guide rail 16 or of the rail body 22 is reduced in the inner limb portion 46, in the vicinity of the shoulder 48, in relation to a greater length of the arch 50 in the region of the outer limb portion 45 and in the region of the shoulder 48. The reduction in the length is, for example, circa 50%. The length of the arch 50 in the outer limb portion 45 and over the shoulder 48 is, for example, identical.

In the region of the inner limb portion 46 and upward on the vertical limb 36 from the bending edge 47 as far as close to the mounting holes 38, the arch is strip-shaped and forms centrally over a partial length of, for example, 20% of the entire length of the fastening element.

In the region of the outer limb portion 45, the arch extends over the substantial length of the outer limb portion 45, for example, over 80% and more, for example, over 90% of the length of the outer limb portion 45. The arch 50 is preferably formed continuously over its entire extent. The arch 50 is formed continuously from the outer limb portion 45 over the shoulder 48, the inner limb portion 46, the bending edge 47 and the vertical limb 36.

Figure 10:
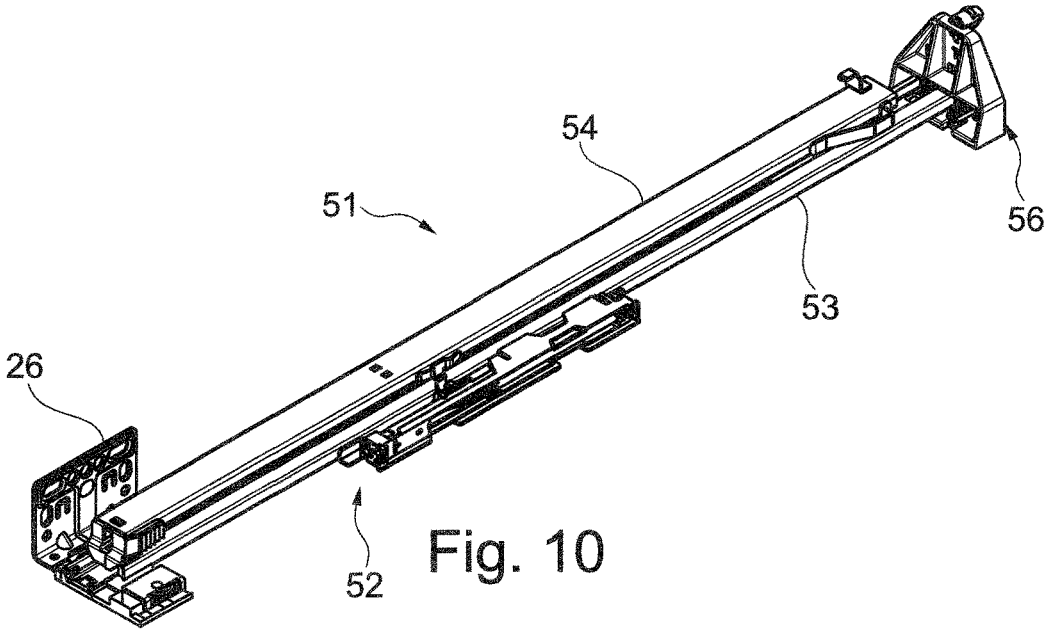
FIG. 10 shows a perspective view of an alternative guide system obliquely from above.
Figure 11:
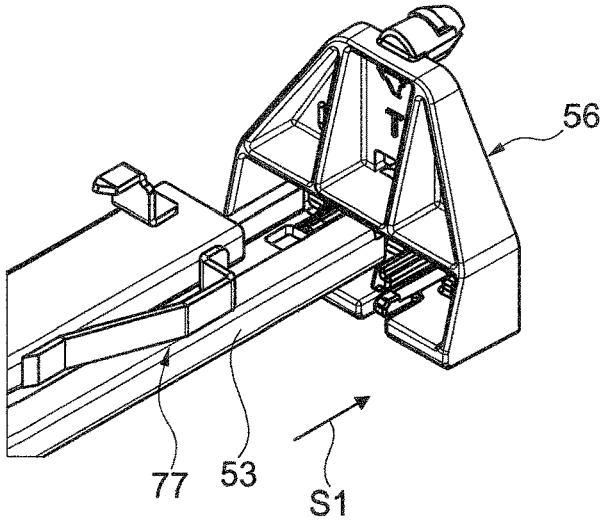
FIG. 11 shows an enlarged detail from FIG. 10.
Figure 12:
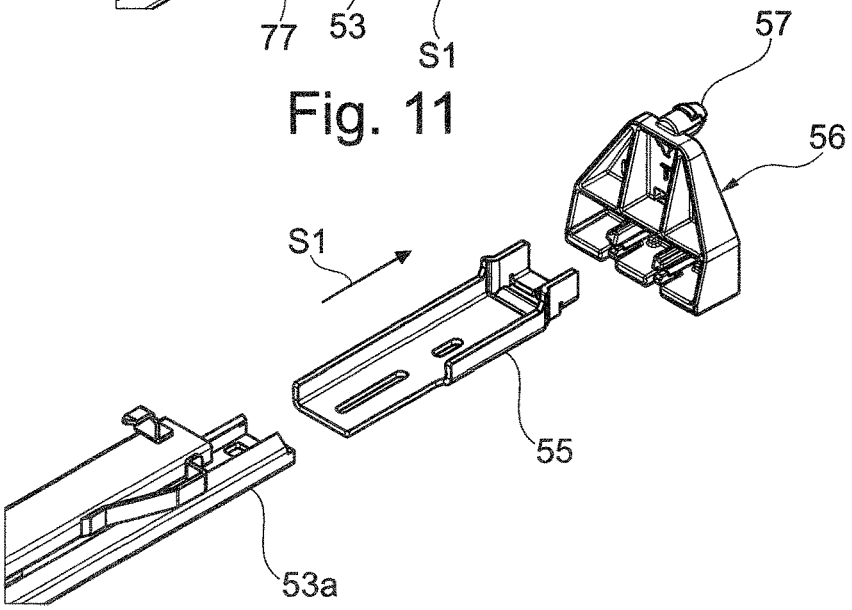
FIG. 12 shows a detail of a rear portion of an alternative guide system in an exploded illustration.

A structural unit 51 of an alternative guide system according to the present invention is shown in FIGS. 10 to 12.

FIG. 10 shows, in an overall view, a pushed together rail full-extension mechanism 52 with a cabinet rail 53, a push-in element rail 54 and a central rail which is present in between and is concealed in the figures.

The rail full-extension mechanism 52 with the cabinet rail 53 is suitable for a furniture cabinet which does not have a sidewall, and, therefore, a lateral mounting of a rear fastening element in the rearward region of the furniture cabinet via, for example, mounting holes in a mounting portion of the rear fastening element is not possible. When the cabinet sidewall is absent, the front fastening element 26 can be screwed via the vertical limb 36 for example to a front frame element of the furniture cabinet or a "face frame" element which extends rearward in the direction of a depth of the furniture cabinet, for example, over 50 millimeters, and regularly extending in a strip-shaped manner over the entire cabinet height.

The cabinet rail 53 has a fastening element 26 as described above in a front end portion.

An adapter element 56 which is separate from the cabinet rail 53 can be inserted via a plug-in portion 57 protruding to the rear on the rear side thereof into a matching bore in a rear wall of a furniture cabinet (not shown). According to FIGS. 10 and 11, a, for example, approximately U-shaped rear end of a rail body 53*a* of the cabinet rail 53 can be inserted into matching mating portions on the adapter element 56 in direction S1 such that a rear end of the rail full-extension mechanism 52 can be mounted in a fixedly supported manner on the furniture cabinet.

FIG. 12 shows a modification of FIGS. 10 and 11. At the rear end of the cabinet rail 53, there is optionally an intermediate piece 55 which is connected to a rear end of the rail body 53*a* of the cabinet rail 53 in the state of use. The intermediate piece 55 can be used, for example, if the rail body 53*a* has too short a length, to extend the latter by choice or optionally. A rearward, for example, approximately U-shaped end of the intermediate piece 55 can be plugged into matching mating portions on the adapter element 56 such that a rear end of the rail full-extension mechanism 52 can be mounted in a fixedly supported manner on the furniture cabinet. The rail body 53*a* is connected to the metallic intermediate piece 55, for example, releasably, or fixedly, for example, welded thereto.

The intermediate piece 55 is preferably placed on or attached to the rail body 53*a*. The intermediate piece 55 can be selected, for example, from a set of intermediate pieces which are identically shaped but differ in length or from a plurality of available intermediate pieces which are identical in shape but differ in length, for example, in the form of a plug-on adapter. The plug-on adapters, for example, from the set have different lengths. Precisely one plug-on adapter with a matching or desired length can thus be selected.

The adapter element 56 is preferably composed of a plastics material and has a groove for a side adjustment of the intermediate piece 55 or of the rail or of the rail body 53*a*.

FIG. 13A shows a guide rail 58 or cabinet rail as an alternative to the guide rail 16, in an exploded illustration. In the assembled state of the guide rail 58, precisely two identical fastening elements 26 abut the rail body 59 of the guide rail 58. The fastening elements 26 are configured identically to the front fastening element 26 according to the guide rail 16 and abut the surface side 60 on the rail body 59. The front and the rear fastening element 26 are, for example, each mounted flush on the surface side 60 of the rail body 59. For example, a front edge of the front fastening element 26 is flush, or offset only in the millimeter range, with the front edge of the surface side 60 of the rail body 59. For example, a rear edge of the rear fastening element 26 is flush, or offset only in the millimeter range, with the rear edge of the surface side 60 of the rail body 59.

Opposite parallel, elongate narrow and, for example, channel-shaped recesses 59*a* on the front longitudinal end portion of the rail body 59 are present on the inner face and are upwardly open in the base 39 of the rail body 59, for example, by means of a material recess. The recesses 59*a* reach as far as the front side of the rail body 59 and form a wall thickness weakening of the rail body 59 over a comparatively short longitudinal portion of the base 39.

The recesses 59*a* of the rail body 59 serve to avoid comparatively small, but interfering scraping off of material by frictional contact with downwardly directed, bent-over edges of the central rail 17 and to avoid scraping noises with the edges of the central rail 17, which may otherwise be the case, for example, due to lowering the central rail, in particular, when the rail extension mechanism is pushed out.

Figure 13B:
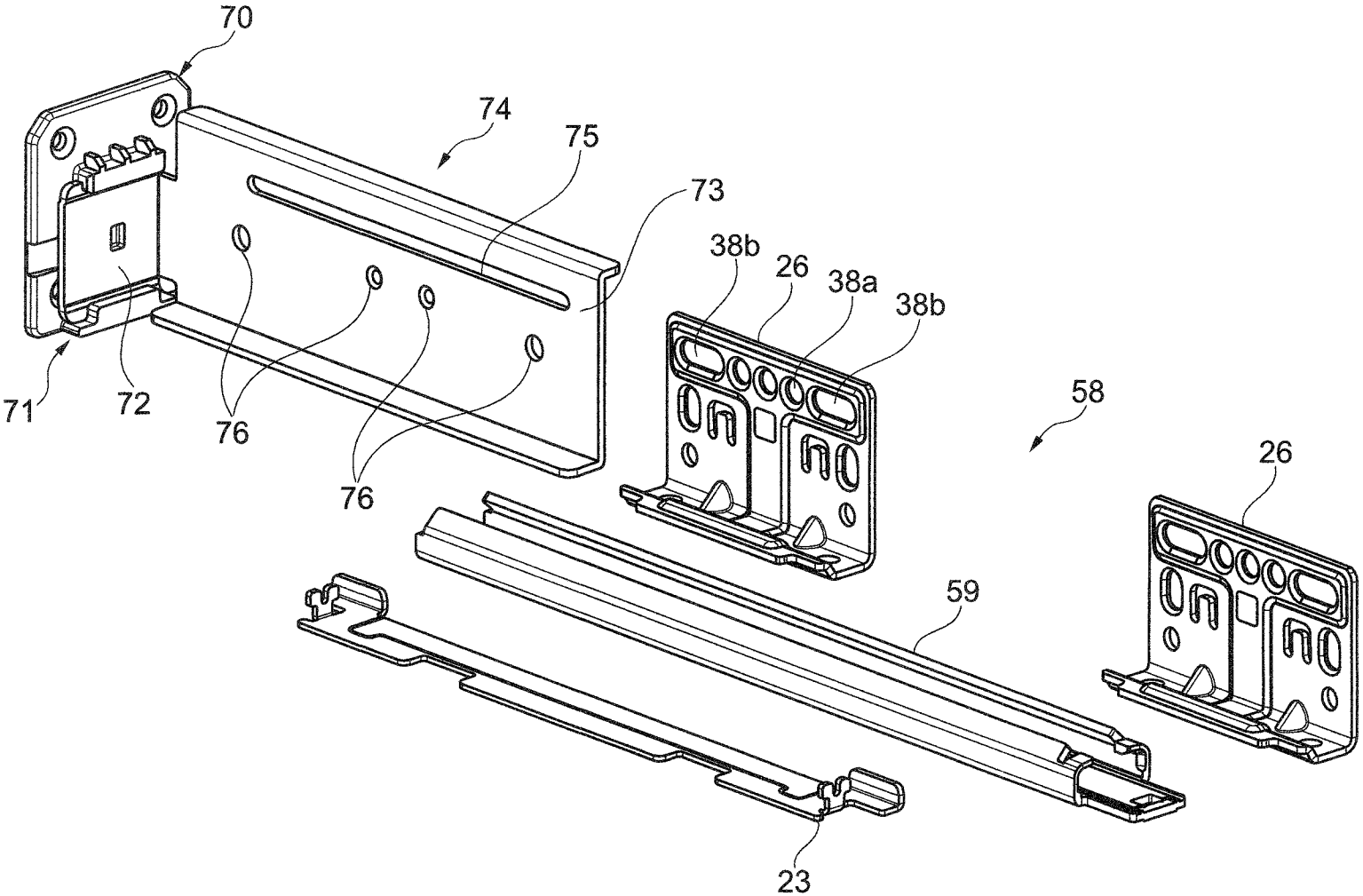
FIG. 13B shows a further alternative guide view in an exploded illustration.

FIG. 13B shows a modification of the present invention, with which the guide rail 58 can be fastened to a rear wall of the furniture cabinet (not illustrated) by means of a receiving element 74 when the sidewall of the furniture cabinet is absent. For this purpose, a plate-like adapter element 70 which can be screwed to the rear wall of the furniture cabinet is provided with a plug-in contour 71 having opposite parallel grooves. A matching plate-like plug-in tongue 72 of the receiving element 74 is pushed in on the plug-in contour 71 and fastened in a clamping manner. The plug-in tongue 72 is at right angle to a limb portion 73 of the receiving element 74. In the mounted state, the limb portion 73 extends forward in the longitudinal direction of the guide rail 58 or of the rail body 59.

The limb portion 73 is provided with an elongated hole 75 running in the longitudinal direction of the rail body 59 and with a plurality of round screwing-on holes 79 present below the elongated hole. In order to fasten the fastening element 26 to the receiving element 74 or to the limb portion 73 thereof, use is made of, for example, screwing mechanisms which reach through the mounting holes 38*a* and/or through the elongated holes 38*b* and through the elongated hole 75 and the screwing-on holes 76. An adjustment of the position of the guide rail 58 on the receiving element 74 in the longitudinal direction of the guide rail 58 is possible here along the longitudinal extent of the elongated hole 75.

LIST OF REFERENCE SIGNS

1 Furniture item
2 Furniture cabinet
3 Drawer
4 Sidewall
4*a* Inner face
5 Sidewall
6 Rail full-extension mechanism
7 Rail full-extension mechanism
8 Rail full-extension mechanism
9 Rail full-extension mechanism
10 Drawer sidewall
11 Drawer sidewall
12 Front element
13 Rear wall
14 Drawer base
15 Cabinet base
16 Cabinet rail
17 Central rail
18 Push-in element rail
18*a* Upper side
19 Hook element
20 Carriage
21 Carriage
22 Rail body
23 Receptacle
24 Movement mechanism
25 Depth adjustment element
26 Fastening element
27 Fastening element
28 Attachment piece
28*a* Edge portion
29 Tab
30 Portion
31 Tab
32 Portion
33 Surface side
34 Edge portion
35 Flat material portion
35*a* Main side
35*b* Main side
36 Vertical limb
37 Horizontal limb
38*a* Mounting hole
38*b* Elongated hole
39 Base
40 Side
41 Side
42 Longitudinal web
43 Longitudinal web
44 Contact surface
45 Limb portion
46 Limb portion
47 Bending edge
48 Shoulder
49 Rib
50 Arch
51 Structural unit
52 Rail full-extension mechanism
53 Cabinet rail
53*a* Rail body
54 Push-in element rail
55 Intermediate piece
56 Adapter element
57 Plug-in portion
58 Guide rail
59 Rail body
59*a* Recess
60 Surface side
61 Mounting element
62 Horizontal limb
63 Vertical limb
64 Clamping portion
65 Clamping portion
66 Mounting element
66*a* Plug-in projection
67 Horizontal limb
67*a* Side
67*b* Side
68 Web
69 Web
70 Adapter element
71 Plug-in contour
72 Plug-in tongue
73 Limb portion
74 Receiving element
75 Elongated hole
76 Screwing-on hole
77 Positioning portion
77*a* Ramp portion
77*b* Contact portion
78 Cutout
79 Mating portion
80 Notch
81 Latching means

The invention claimed is:

1. A guide rail of a guide system for a push-in element, the guide rail comprising:

a rail body; and a fastening element, wherein the fastening element is configured to fasten the guide rail on a mating portion in a use state of the guide system, wherein the fastening element is mounted on the rail body and is connected thereto, the fastening element having a flat material portion with opposite main sides and with a narrow front edge portion between the main sides, wherein in a state where the fastening element is connected to the rail body, the front edge portion of the fastening element abuts a surface side of the rail body, the surface side being oriented upright in a use state of the guide rail, wherein the fastening element is configured as a bracket element from an angled sheet metal material, the fastening element having limbs oriented at an angle and being connected to each other along a bending edge, and, in the use state of the guide rail, a horizontally configured horizontal limb forming the flat material portion with the front edge portion of the fastening element, wherein the horizontal limb of the fastening element has an inner limb portion adjoining the bending edge and an outer limb portion, wherein the outer limb portion of the horizontal limb of the fastening element adjoins the inner limb portion of the horizontal limb of the fastening element via a shoulder which extends in a longitudinal direction of the rail body, wherein the outer limb portion of the horizontal limb of the fastening element includes the front edge portion of the fastening element, wherein a reinforcing mechanism is provided on the fastening element and comprises an arch which extends along the shoulder over at least a partial region of the outer limb portion of the horizontal limb of the fastening element, wherein the shoulder between the inner limb portion of the horizontal limb of the fastening element and the outer limb portion of the horizontal limb of the fastening element runs continuously over an entire length of the horizontal limb of the fastening element, and wherein the outer limb portion of the horizontal limb of the fastening element is offset in a vertical direction with respect to the inner limb portion of the horizontal limb of the fastening element with respect to the use state of the guide rail.

2. The guide rail as claimed in claim 1, wherein the reinforcing mechanism on the outer limb portion of the horizontal limb of the fastening element extends over a length of the front edge portion of the fastening element, as viewed in a longitudinal direction of the guide rail.

3. The guide rail as claimed in claim 1, wherein the reinforcing mechanism is formed in a central portion of the horizontal limb of the fastening element with respect to a longitudinal direction of the guide rail.

4. The guide rail as claimed in claim 1, wherein the arch is configured continuously as an uninterrupted arch present at the outer limb portion of the horizontal limb of the fastening element and in the region of the shoulder.

5. The guide rail as claimed in claim 1, wherein the arch is formed in the region of the bending edge between the horizontal limb of the fastening element and a vertically oriented limb of the fastening element.

6. The guide rail as claimed in claim 1, wherein the edge portion of the fastening element over its entire length with respect to a longitudinal direction of the guide rail, abuts the upright surface side on the rail body.

7. The guide rail as claimed in claim 1, wherein the fastening element is connected to the surface side on the rail body exclusively via the abutting connection.

8. The guide rail as claimed in claim 1, wherein on the rail body of the guide rail there is only one fastening element, the edge portion of which abuts the surface side of the rail body.

9. The guide rail as claimed in claim 1, wherein on the rail body of the guide rail there are two identically configured fastening elements with an edge portion, the respective edge portion of which abuts the surface side of the rail body.

10. The guide rail as claimed in claim 1, wherein on the rail body of the guide rail there is only one fastening element which abuts the surface side of the rail body, wherein there is a further fastening element which differs from the first fastening element in the configuration and/or in the manner of the connection to the rail body.

11. The guide rail as claimed in claim 1, wherein an attachment piece with an edge portion is provided, wherein the edge portion of the attachment piece abuts the surface side on the rail body, wherein a fastening element is attachable to the attachment piece.

12. A guide system for a push-in element, with a cabinet rail, wherein the cabinet rail is configured as the guide rail as claimed in claim 1.

13. The guide system as claimed in claim 12, wherein there is a push-in element rail on which the push-in element can be arranged in the state of use of the guide system, wherein the push-in element rail has a positioning portion which is configured protruding to an outer side of the push-in element rail and which is configured to predetermine a functionally correct relative position between the push-in element and the push-in element rail, in the state of use of the guide system.

14. A furniture item comprising a cabinet and a push-in element, the push-in element being received movably on the cabinet by way of a guide system, wherein a guide system is present for the push-in element as claimed in claim 12.

* * * * *